US005193615A

United States Patent [19]

Akkerman

[11] Patent Number: 5,193,615

[45] Date of Patent: Mar. 16, 1993

[54] APPARATUS FOR USE IN CONTROLLING FLOW THROUGH A TUBING STRING SUSPENDED AND PACKED OFF WITHIN WELL BORE AS WELL AS WITHIN THE ANNULUS BETWEEN THE TUBING STRING AND WELL BORE ABOVE AND BELOW THE PACKER

[75] Inventor: Neil H. Akkerman, Houston, Tex.

[73] Assignee: AVA International Corporation, Houston, Tex.

[21] Appl. No.: 644,244

[22] Filed: Jan. 22, 1991

Related U.S. Application Data

[63] Continuation of Ser. No. 518,976, May 4, 1990, abandoned.

[51] Int. Cl.[5] ..... E21B 34/10; E21B 23/03

[52] U.S. Cl. ..... 166/129; 166/117.5; 166/183; 166/321; 166/322; 166/324

[58] Field of Search ..... 166/117.5, 129, 145, 166/183, 321, 322, 324, 332

[56] References Cited

U.S. PATENT DOCUMENTS

| | | | |
|---|---|---|---|
| 3,351,133 | 11/1967 | Clark, Jr. et al. | 166/53 |
| 3,375,874 | 4/1968 | Cherry et al. | 166/114 |
| 3,941,190 | 3/1976 | Conover | 166/187 |
| 4,049,052 | 9/1977 | Arendt | 166/183 |
| 4,271,903 | 6/1981 | Slagle, Jr. et al. | 166/129 |
| 4,325,431 | 4/1982 | Akkerman | 166/117.5 |
| 4,354,554 | 10/1982 | Calhoun et al. | 166/321 |
| 4,407,363 | 10/1983 | Akkerman | 166/183 |
| 4,423,782 | 1/1984 | Bowyer | 166/321 |
| 4,432,417 | 2/1984 | Bowyer | 166/120 |
| 4,434,847 | 3/1984 | Vazquez et al. | 166/117.5 |
| 4,461,353 | 7/1984 | Vinzant et al. | 166/322 |
| 4,467,867 | 8/1984 | Baker | 166/188 |
| 4,478,288 | 10/1984 | Bowyer | 166/372 |
| 4,527,631 | 7/1985 | Vazquez | 166/322 |
| 4,540,047 | 9/1985 | Akkerman | 166/188 |
| 4,589,482 | 5/1986 | Baugh, III | 166/117.5 X |
| 4,632,184 | 12/1986 | Renfroe, Jr. et al. | 166/105.5 |
| 4,641,707 | 2/1987 | Akkerman | 166/116 |
| 4,660,647 | 4/1987 | Reihart | 166/117.5 X |

OTHER PUBLICATIONS

Otis Engineering Corporation, p. 42 of brochure published in 1980.

P. 3846, 1966–67 Composite Catalog of Oil Field Equipment and Services.

P. 4012, 1974–75 Composite Catalog of Oil Field Equipment and Services.

P. 4534, 1976–77 Composite Catalog of Oil Field Equipment and Services.

*Primary Examiner*—Hoang C. Dang

*Attorney, Agent, or Firm*—Vaden, Eickenroht, Thompson & Boulware

[57] ABSTRACT

There is disclosed apparatus for use in controlling flow through a tubing string suspended and packed off within a well bore and within the annulus between the string and well bore above and below the packer by tools adapted to be lowered into and raised from landed positions within a pocket to one side of a bore through a mandrel connected as part of the tubing string for releasing the packer to be set and opening a bypass therein and for opening and closing a flapper in the bore, as well as the bypass responsive to the supply of control fluid from a remote source to the pocket.

27 Claims, 11 Drawing Sheets

FIG.1
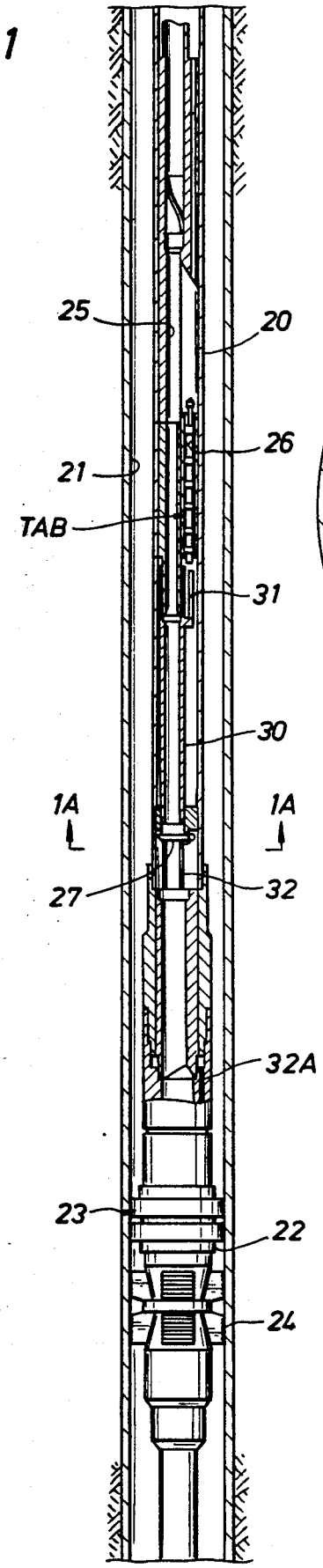
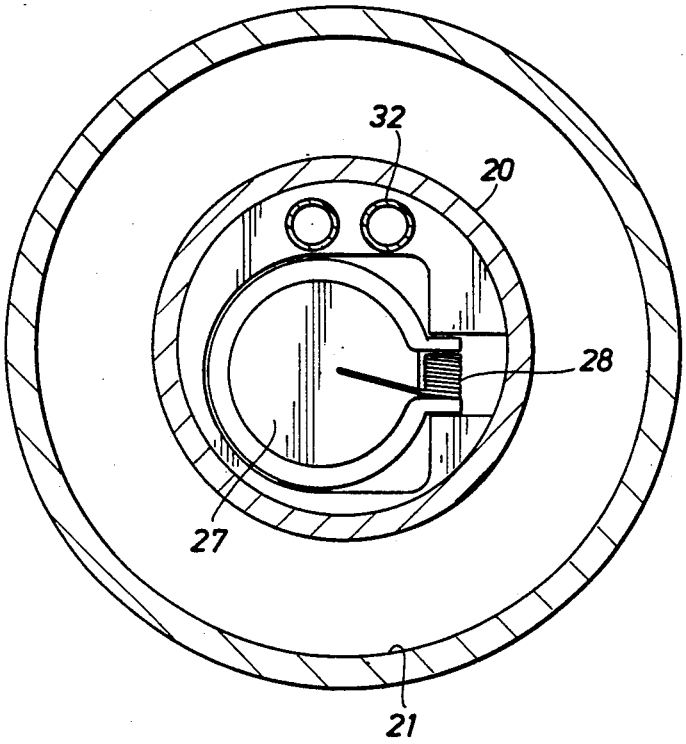
FIG.1A

APPARATUS FOR USE IN CONTROLLING FLOW THROUGH A TUBING STRING SUSPENDED AND PACKED OFF WITHIN WELL BORE AS WELL AS WITHIN THE ANNULUS BETWEEN THE TUBING STRING AND WELL BORE ABOVE AND BELOW THE PACKERWELL APPARATUS

This application is a continuation of copending U.S. patent application Ser. No. 07/518,976, filed May 5, 1990, and entitled "Well Apparatus"now abandoned.

This invention relates generally to apparatus for use in providing "fail safe" control over flow through a tubing string suspended and packed off within a well bore as well as within the annulus between the tubing string and well bore above and below the packer. More particularly, it relates to improvements in apparatus of this type wherein flow is controlled through each of the tubing string and annulus by means of a tool landed within a pocket to one side of the bore of a mandrel connected as part of the tubing string for opening a normally closed flapper in the bore of the mandrel and a valve member within the tool normally closing a passageway connecting the annulus above and below the packer, each in response to the supply of control fluid to the tool from a remote source, and permitting the flapper and valve member to return to closed position in response to the loss of control fluid. In one of its aspects, it relates to such improved apparatus wherein, prior to landing of the flow controlling tool another tool is landable within a pocket of a mandrel connected as part of the drill string for use in first releasing the packer for expansion into engagement with the well bore and opening a bypass in the packer responsive to the supply of control fluid to the tool, whereby the bypass connects with the passageway connecting the annulus above and below the packer when the flow controlling tool is landed. In another of its aspects, it relates to such improved apparatus which includes one or more additional tools landable within a pocket for use in performing other related operations within the well bore both before and following setting of the packer and maintenance of fail safe control through the tubing string and annulus.

As explained in U.S. Pat. No. 4,325,431, assigned to the assignee of the present ion, the above described apparatus for controlling flow through the tubing is an improvement upon more conventional tubing mounted and wireline retrievable safety valves in that it provides a full opening through the tubing while, at the same time, permitting seals and other parts for operating the closure member to be retrieved with the tool and repaired or replaced without pulling the entire tubing string. As further disclosed in such patent, the tool and mandrel in which it is landed provide a passageway which connects the mandrel bore above and below the closure member and which is normally closed by a valve member in tool which is adapted to be opened in response to the supply of control fluid thereto, prior to opening of the flapper, so that, as in prior tubing safety valves, well pressure across the flapper is equalized to facilitate opening it despite high well pressure beneath it.

Although the valve means conventionally used for controlling flow through the equalizing passageway is returned to closed position as the flapper moves to its fully open position, it is again opened and closed, as the flapper returns to closed position, resulting in many cases in a blast of high pressure well fluid through the passageway which may damage the valve means and/or the passageway. Also, if sand or other debris has accumulated in the passageway, the valve means may not fully seat. However, as compared with prior safety valves of this type, the valve means for controlling the equalizing passageway of the safety valve of U.S. Pat. No. 4,641,707, also assigned to the assignee of the present application, remains in closed position as the closure member returns to its closed position. Thus, the flow tube for operating the flapper and the valve means have detents which are engageable with one another to move the valve means to open position, as the flow tube is lowered toward a position to open the closure member, and to remain in such position when the closure member closes.

U.S. Pat. No. 4,540,047, also assigned to the assignee of the present application, discloses apparatus of the type above mentioned in which another mandrel connected as part of the tubing string beneath the mandrel in which the flapper is mounted carries a packer for closing off the annulus between the tubing string and the well bore, and in which a tool is landable within a side pocket of the mandrel to provide, with the mandrel, a passageway which connects with a bypass in the packer for connecting the annulus above the packer with the annulus below the packer.

More particularly, the packer includes means for closing the bypass and for holding the packer in contracted position which is responsive to control fluid supplied to the tool in order to open the bypass and release the packer for expansion. At this time, the tool is removed from the pocket of the lower mandrel and replaced by another tool having valve means therein for controlling flow through a passageway provided by the tool and mandrel and connecting with the bypass to connect the annulus above and below the packer. This valve means, like the flapper of the tubing safety valve of U.S. Pat. No 4,325,431, is normally held in open position by the supply of control fluid thereto, but adapted to close upon loss of such fluid.

Inasmuch as a well completion system of this type requires installation and removal of this tool through the upper mandrel, the flapper in the tubing must be held open so that it will not sever the wire line on which the tool is run. However, the first described flow controlling tool is inherently incapable of holding the tubing safety valve open for this purpose since it is responsive to control line fluid which would be lost upon removal of either the packer releasing and bypass opening tool or the annulus safety valve tool from the lower pocket.

Thus, in accordance with U.S. Pat. No. 4,407,363, also assigned to the assignee of the present application, another tool adapted to be lowered into the pocket of the upper mandrel which is adapted to receive the tool for operating the closure member is responsive to the supply of control fluid thereto for moving the flapper to open position and holding it in such position whereby other tools are raised and lowered to positions beneath the flapper. Then, upon completion of such operations, the tool for locking the flapper open may be removed from the pocket in the upper mandrel and replaced with the tool for operating the closure member in order to control flow through the tubing.

Although providing substantial improvements over conventional prior art tubing and annulus safety valves, the above described apparatus is nevertheless of complex and expensive construction in that it requires the use of mandrels with two side pockets, the manipulation of four tools landable within them for the purposes described, and an extended control fluid line for connection to both pockets.

It is therefore the primary object of this invention to provide apparatus of this type which is of more simplified construction and less expensive construction, and, more particularly, in which only one mandrel having a side pocket adapted to receive selected ones of only two tools are required for performing the same operations.

Another object is to provide such apparatus in which the mandrel and a tool for operating the closure member form a passageway through which pressure may be equalized across the closure member without reopening the valve in the passageway as the closure member returns to closed position.

A further object is to provide such apparatus whereon one or more additional tools may be landed in the same pocket for performing related functions and operations in response to the supply of control fluid.

Thus, in accordance with the illustrated embodiment of the present invention, apparatus is provided which includes, as in the prior apparatus, a mandrel having a bore therethrough adapted to be connected as part of the tubing string and a pocket to one side of the bore, a closure member movable within the bore of the body between positions opening and closing the bore, and means urging the closure to closed position. More particularly, the apparatus includes a tool movable vertically through the body and into and out of a landed position within the pocket, and an actuator movable between a first position permitting the closure member to move to closed position and a second position in which it moves the closure member to open position. However, as compared with the prior apparatus, and in accordance with one novel aspect of the invention, the tool and mandrel also provide, when the tool is landed in the pocket, a passageway for connecting the annulus above and below the packer, and the tool also has valve means therein movable from a first position closing the passageway to a second position opening the passageway, with each of said actuator and valve means having pressure responsive means for moving it to its second position, the mandrel having a second passageway therein for supplying control fluid from a remote source to the pressure responsive means in order to move each of said actuator and valve means from its first to its second positions, and the actuator means and valve means being returned to their first positions following loss of control line pressure.

In accordance with another novel aspect of the invention, the mandrel and tool also have means which, when the tool is landed, forms a third passageway connecting the mandrel above and below the closure member, and the tool also includes valve means movable from a position closing the third passageway to a position opening same, in response to the supply of control fluid thereto, and prior to the opening of the closure member, and adapted to be returned to and held in its closed position following opening of said closure member.

A packer mounted on a tubular body having a mandrel forming a lower extension of the mandrel includes a packing element about the body adapted to be expanded into sealing engagement with the bore, means movable from a first to a second position for expanding the packer, a bypass in the packer, means movable between a first position closing the bypass and a second position opening the bypass, and pressure responsive means movable between a first position holding each of said expanding means and bypass closing means in their first positions and a second position for releasing them for movement to their second positions. In accordance with another novel aspect of the invention, a first tool is lowerable through the body into and out of the pocket, prior to landing of the tubing flow controlling tool therein, and the mandrel and first tool form a passageway which, when the first tool is landed, supplies control fluid from the remote source to the pressure responsive means for releasing said holding means and opening said bypass.

The first tool is then removed and replaced in the pocket by the tool for controlling flow through the tubing and annulus, as above described. Hence, the mandrel has various passageways which cooperate with both tools alternately landable within its single pocket to permit operations to be performed with only a single mandrel each having a single pocket.

More particularly, the apparatus includes other tools selectively landable in the pocket and responsive to the supply of control fluid to pressure responsive means in the tool for performing other operations, such as the circulation of fluid downwardly through the annulus and upwardly through the open closure member following setting of the packer and opening of the bypass. In addition, another tool landed in the pocket is responsive to supply of control fluid to another safety valve mounted in the tubing above the closure member so as to control flow through the tubing in the event of malfunction of the closure member, while maintaining control over the annulus through valve means in the tool similar to that previously described.

In the drawings, wherein like reference characters are used throughout to designate like parts:

FIG. 1 is a longitudinal sectional view of a portion of a well, including a tubing string suspended within and packed off within a cased well bore and including a mandrel connected as part of the tubing string and having a pocket to one side of its bore and a tool landed in the pocket for use in operating a flapper type closure member mounted within the bore below the pocket for controlling flow through the tubing string and having a valve therein for controlling flow through a gas passageway connecting the annulus between the tubing string and well bore above and below the packer in response to the supply of control fluid or exhaust of control fluid from the tool;

FIG. 1A is an enlarged cross-sectional view of a portion of the mandrel, as seen along broken lines IA-IA of FIG. 1, and showing the lower side of the flapper and conduits extending within the mandrel to one side of the flapper to connect the passageways with the bypass through the packer;

Figure 5A:
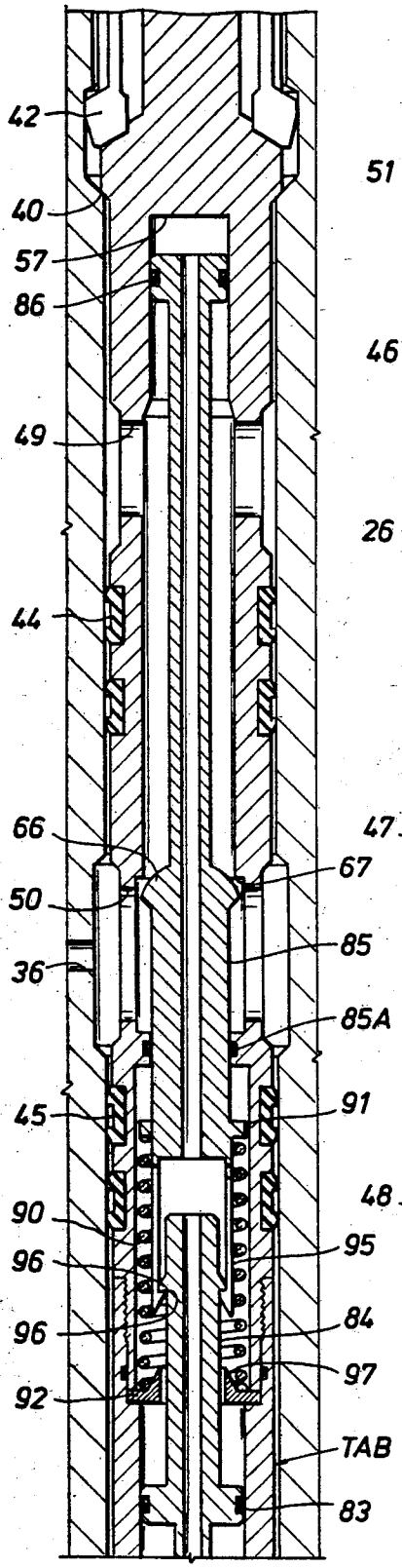
Figure 5B:
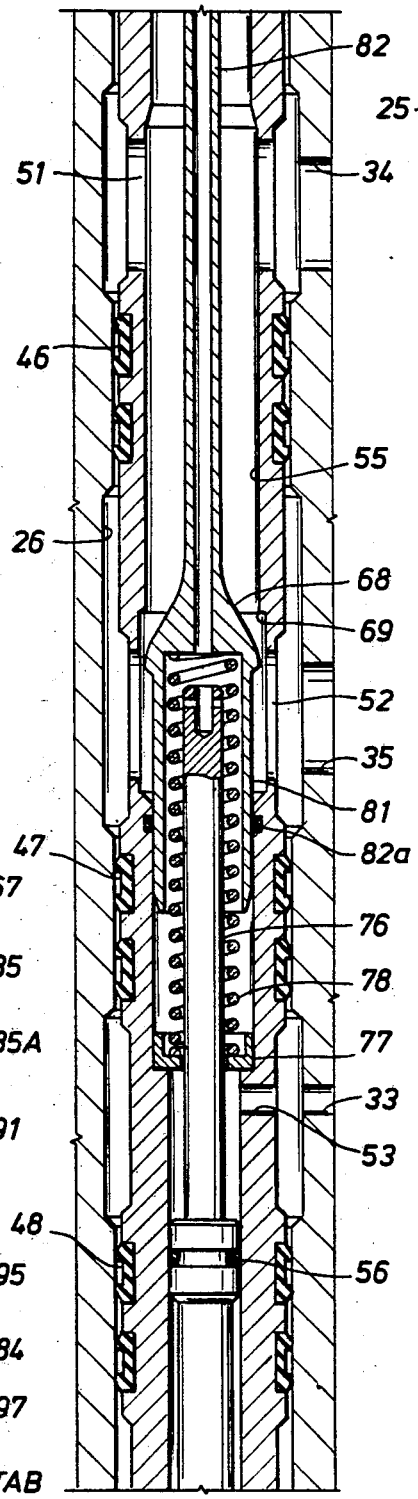
Figure 5C:
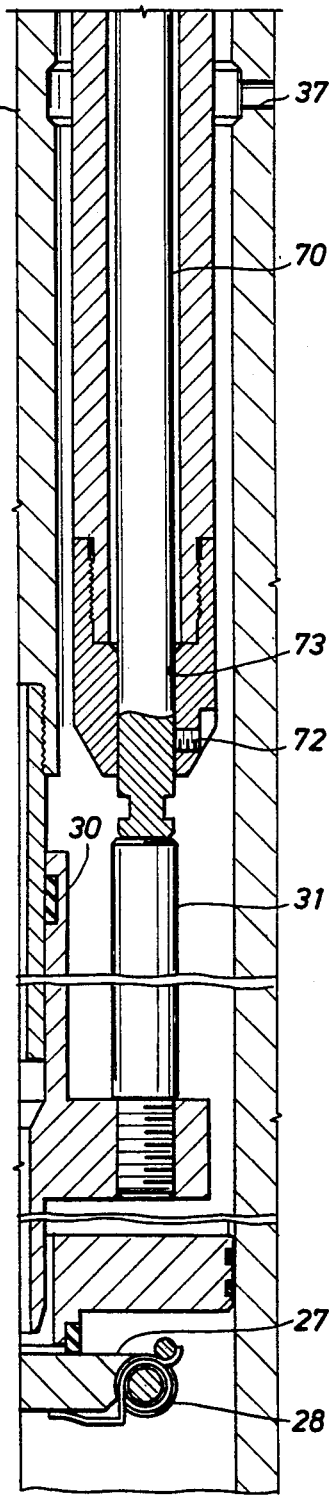
Figure 6A:
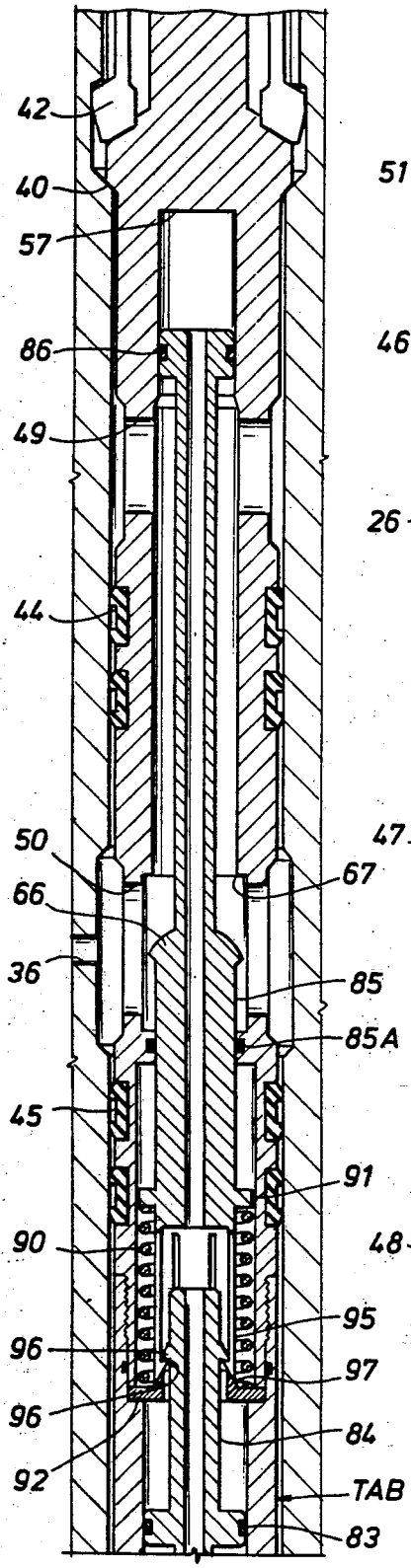
Figure 6B:
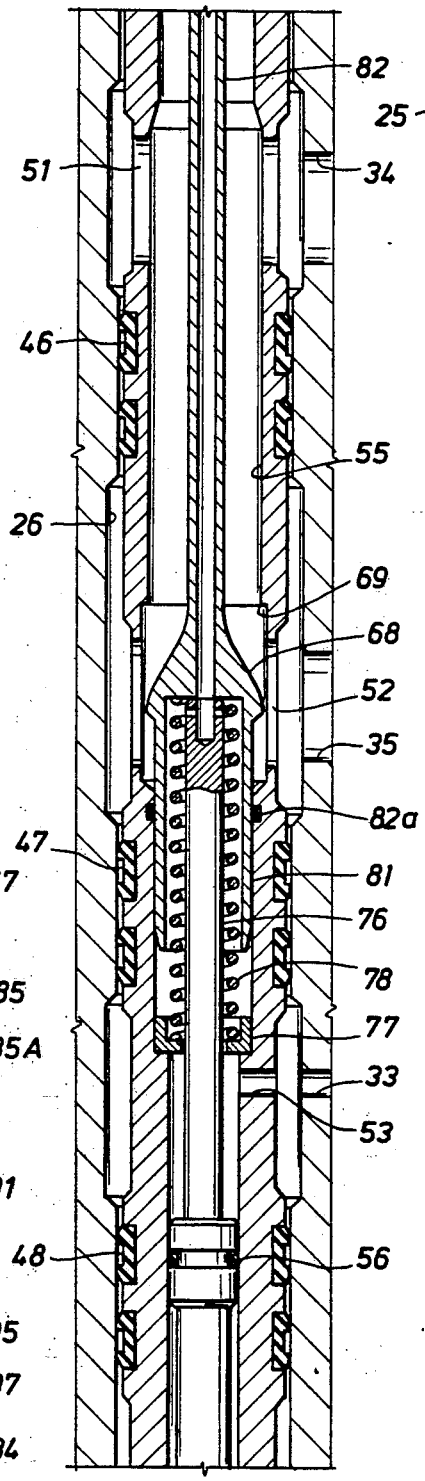
Figure 6C:
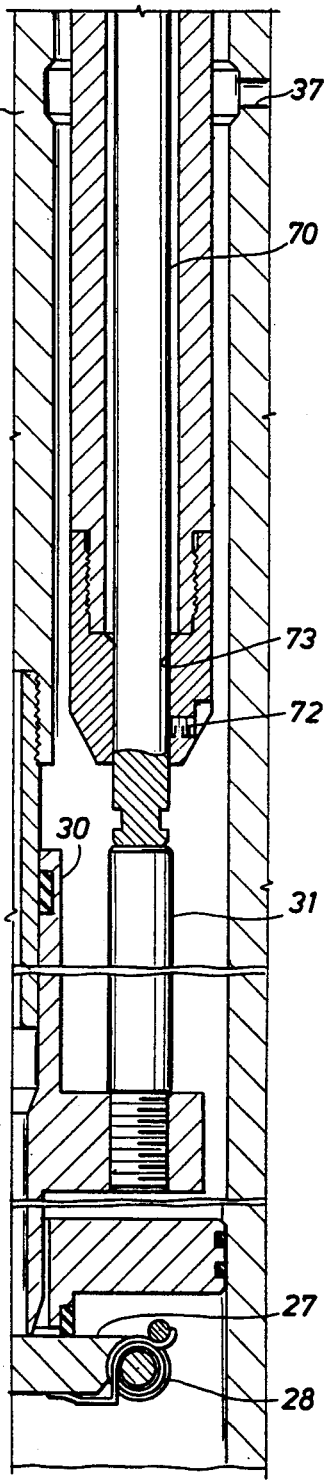
Figure 7A:
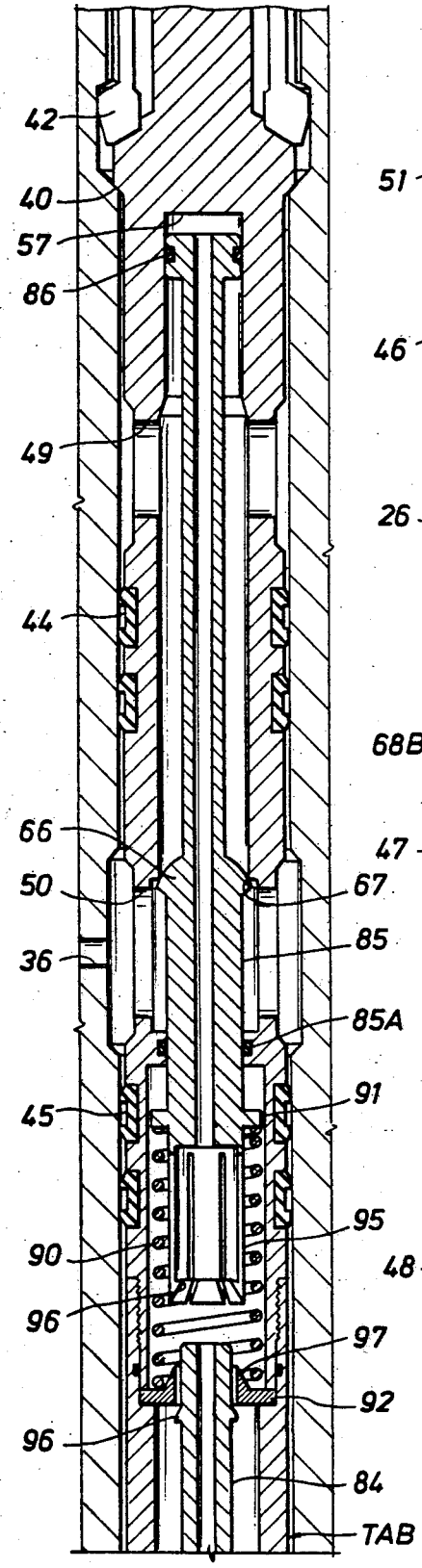
Figure 7B:
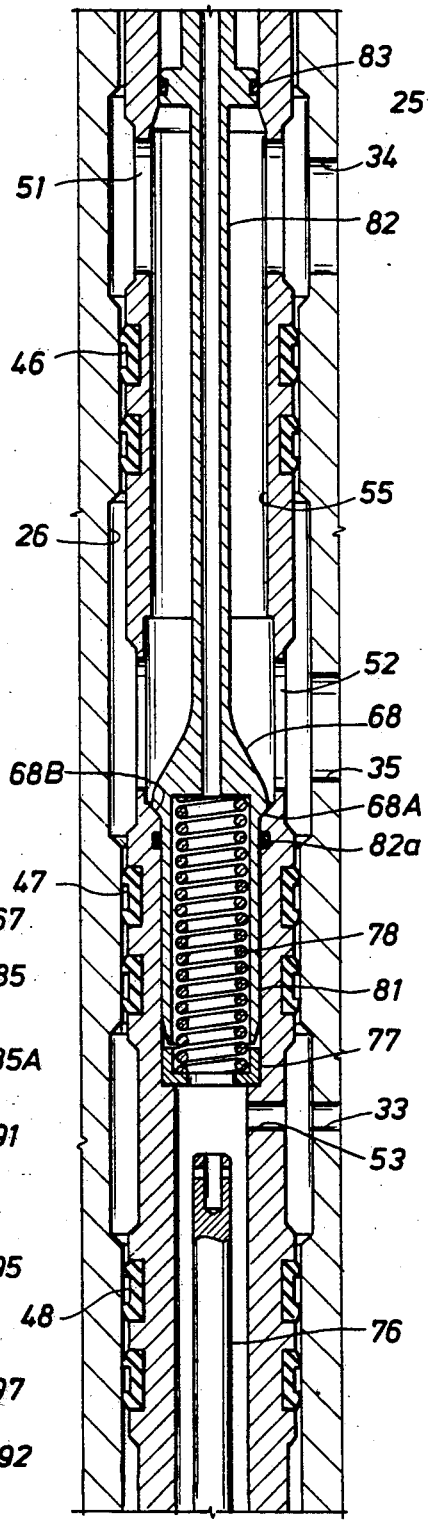
Figure 7C:
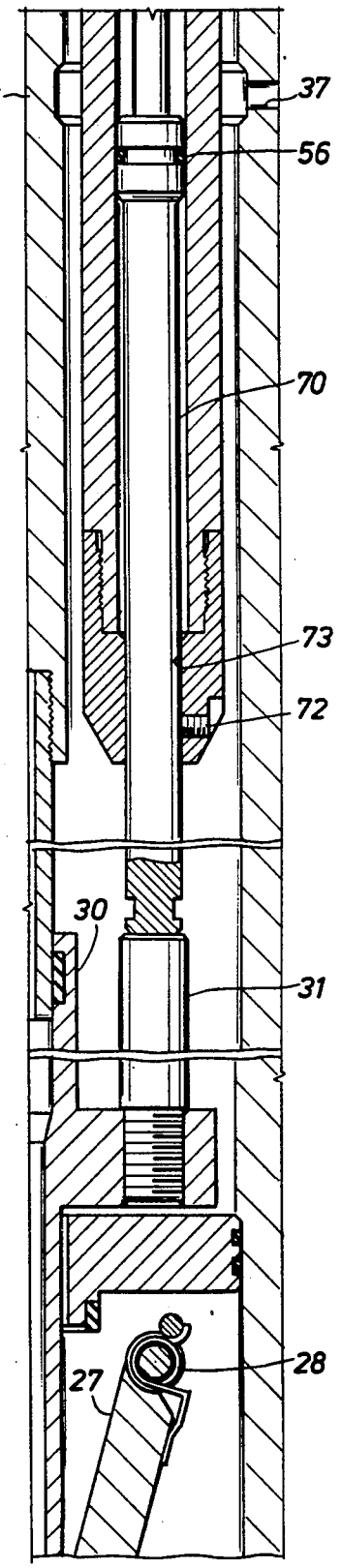
Figure 8A:
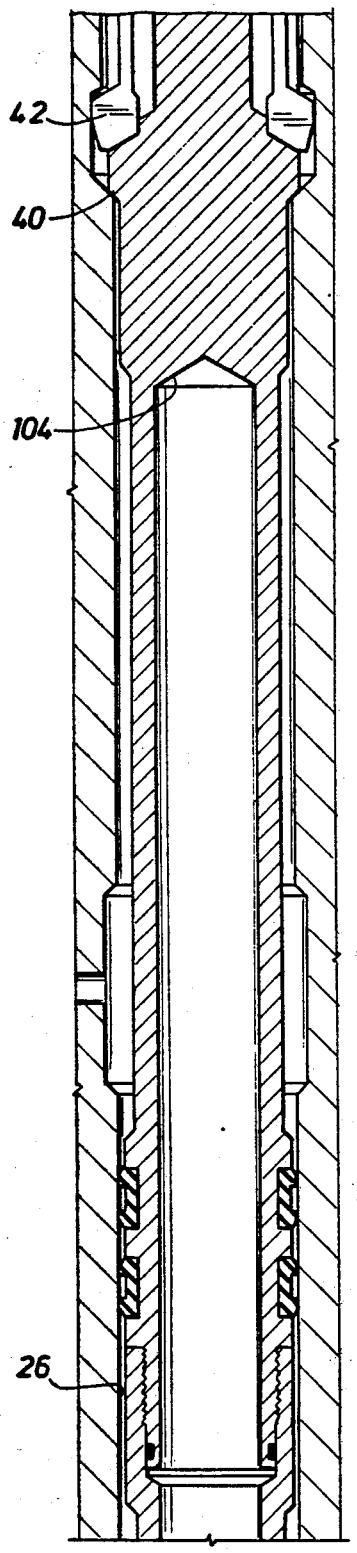
Figure 8B:
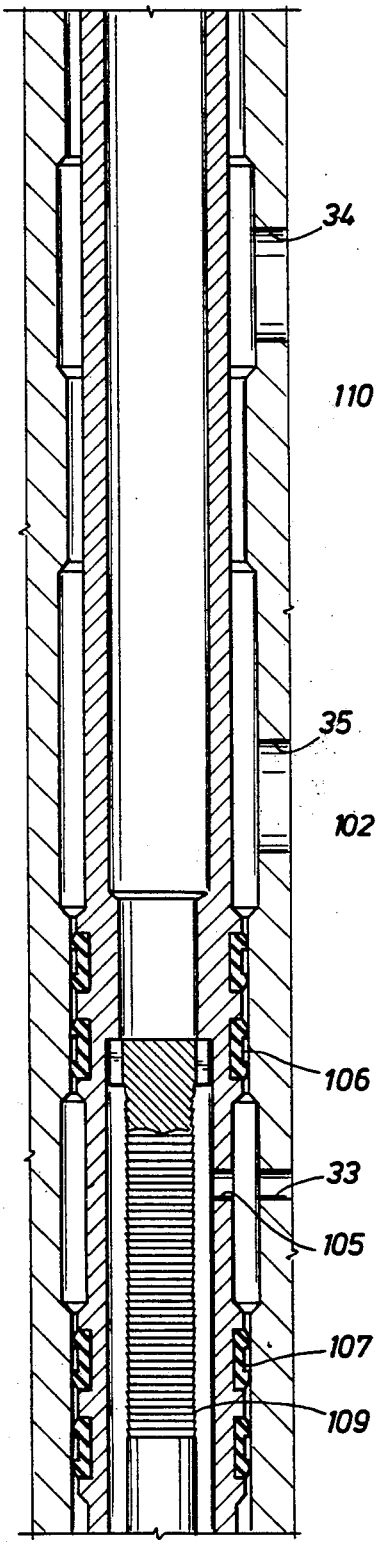
Figure 8C:
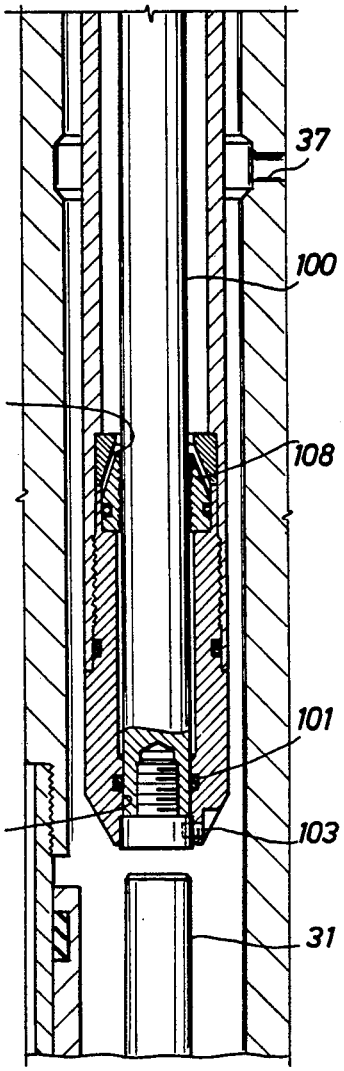
Figure 9A:
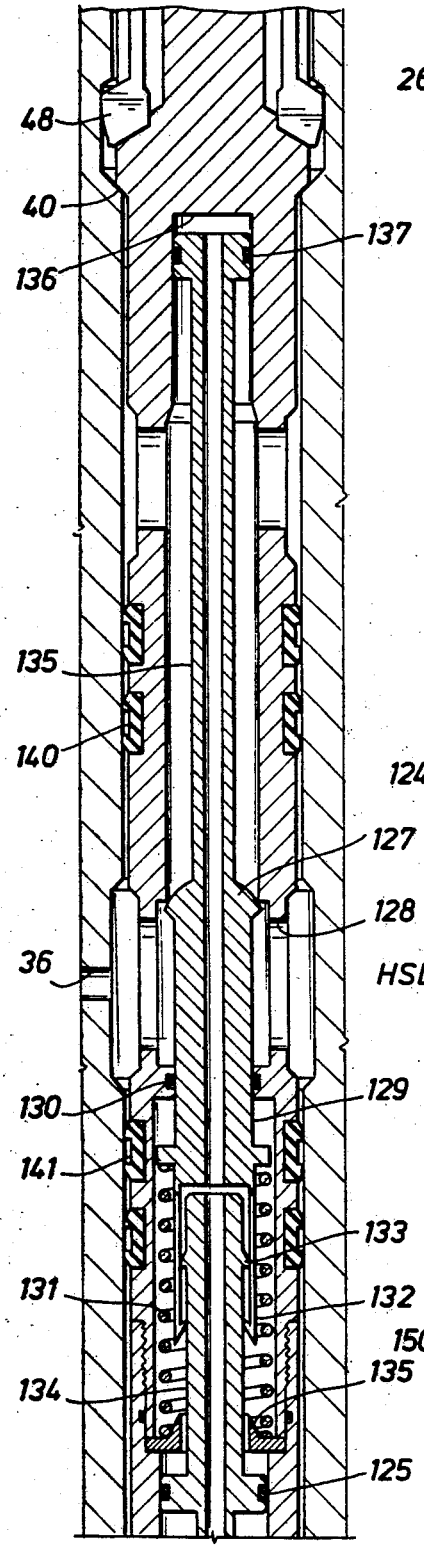
Figure 9B:
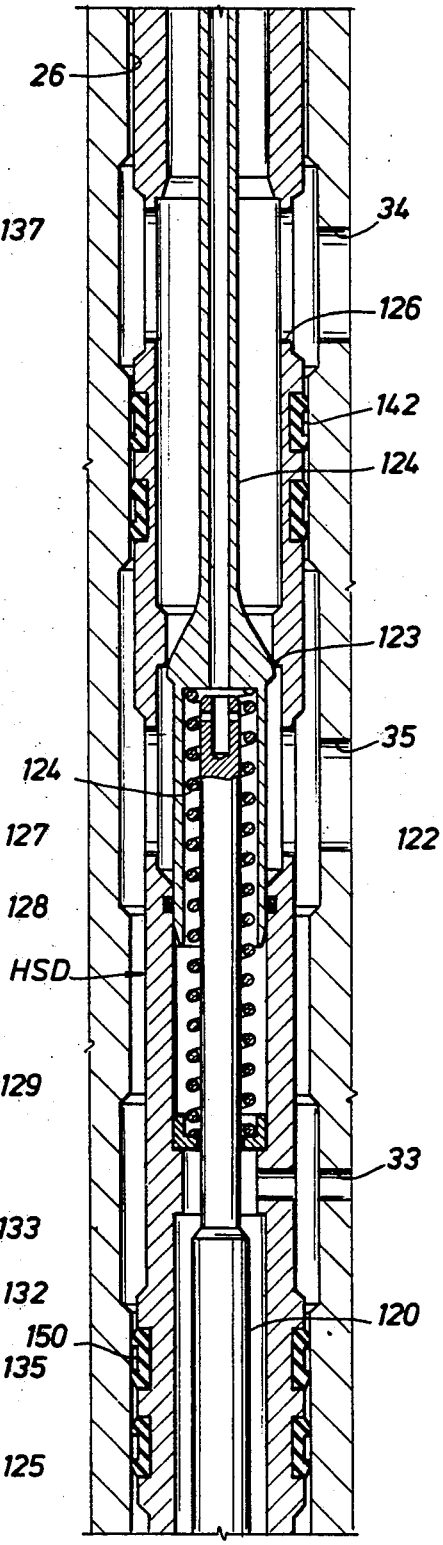
Figure 9C:
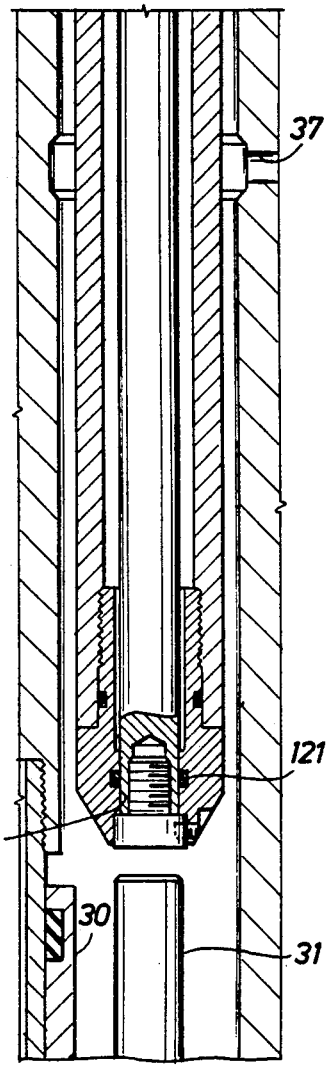
Figure 10A:
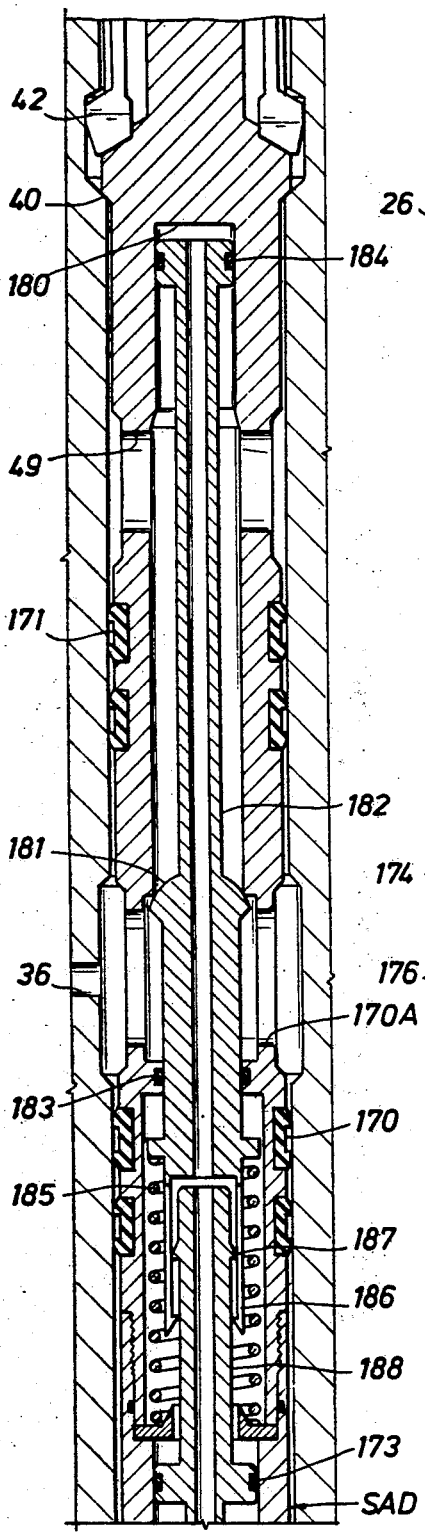
Figure 10B:
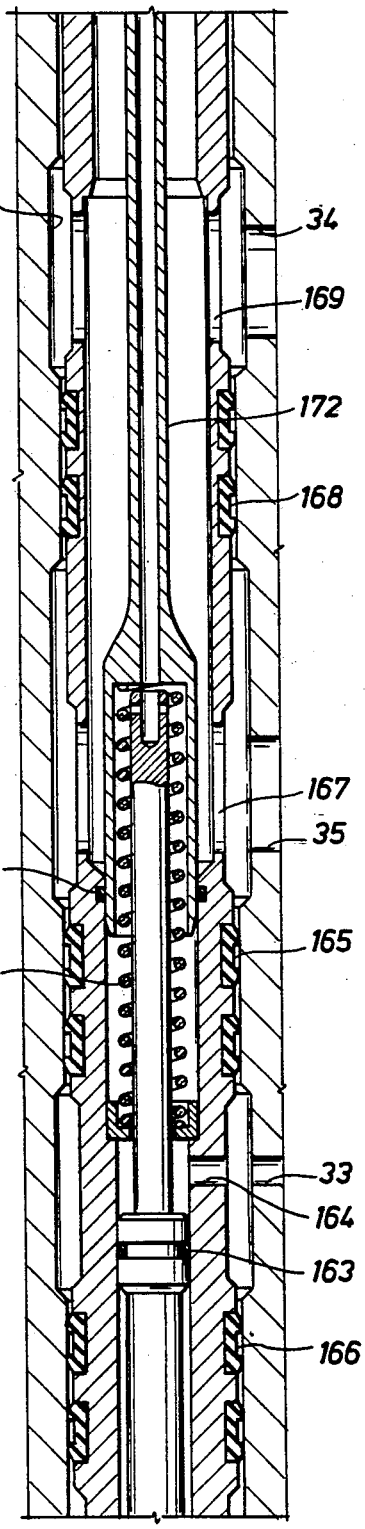
Figure 10C:
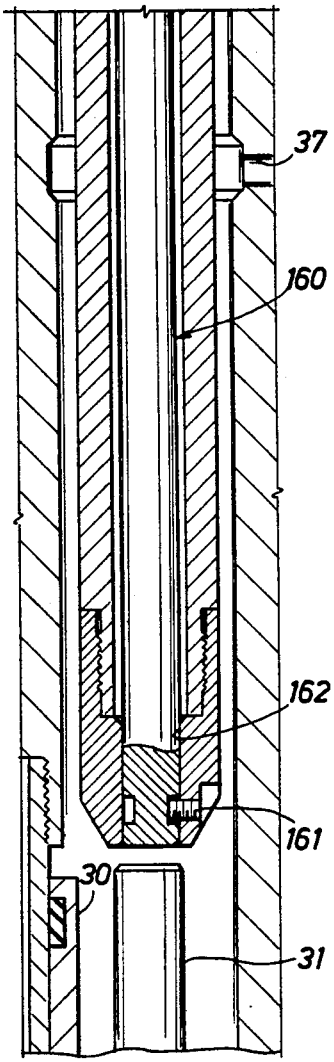
Figure 11A:
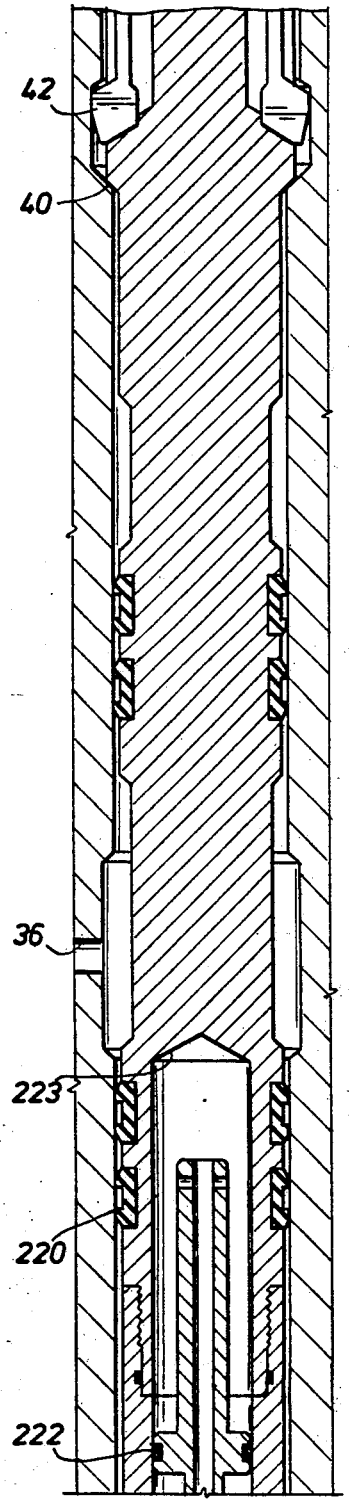
Figure 11B:
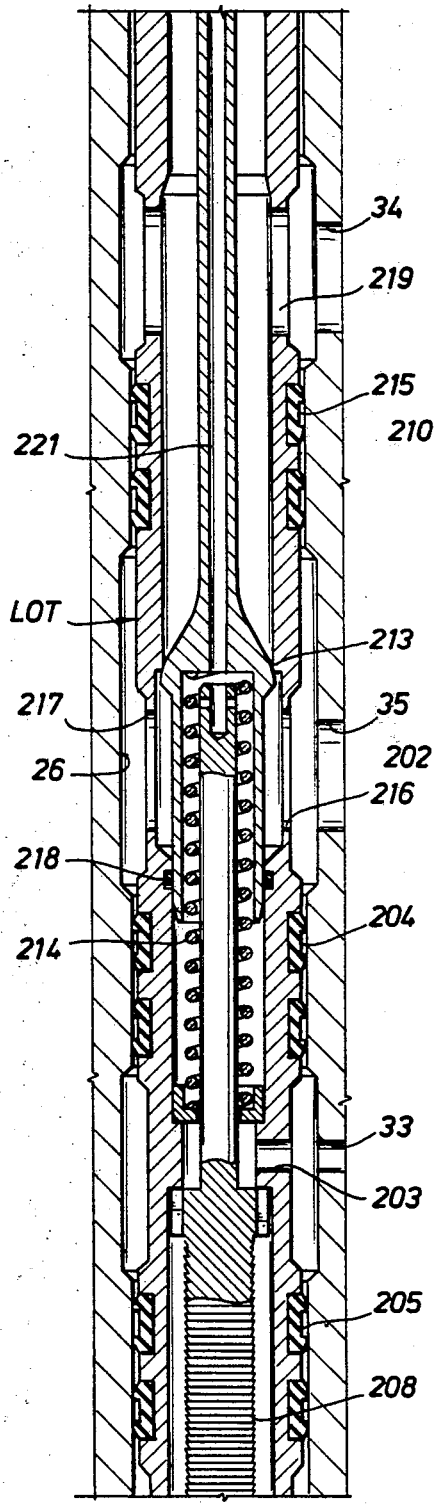
Figure 11C:
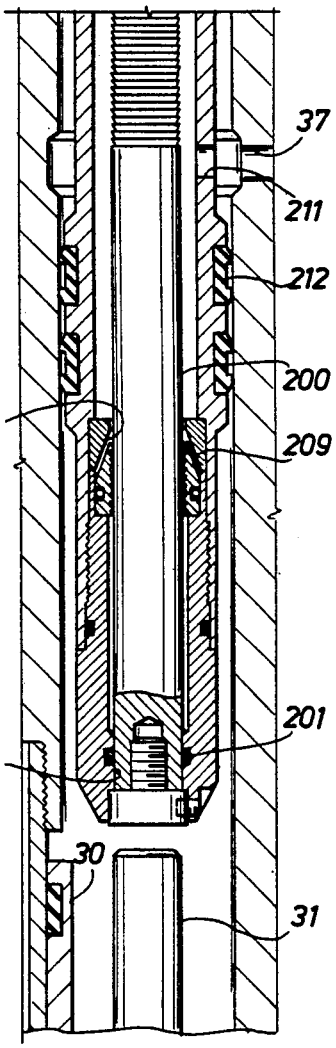

FIGS. 5A, 5B and 5C are vertical sectional views of the upper, intermediate and lower portions of the tool following continued supply of control fluid to further lower the actuator rod and thus lower the flow tube to a position in which its lower end is close to the upper side of the flapper, as well as to open valve means within the tool to open an equalizing passageway in the mandrel connecting its bore above and below the flapper and to connect upper and lower portions of the gas passageway through the tool with the annulus above the packer with the annulus below it;

FIGS. 6A, 6B and 6C are upper, intermediate and lower portions of the mandrel and tool following continued supply of well fluid to force the flow tube downwardly to cause its lower end to engage with the upper side of the flapper and to further open the valve member controlling the gas passageway as well as the valve member for opening the equalizing passageway;

FIGS. 7A, 7B and 7C are vertical sectional views of the upper, intermediate and lower portions of the mandrel and tool upon the continued supply of pressure fluid to the tool to further lower the flow tube so as to push the flapper to open position, as well as to further open the equalizing valve member to a position in which a detent on its lower end is disengaged from the upper end of the gas passageway valve member for return to its closed position;

FIGS. 8A, 8B and 8C are vertical sectional views of the mandrel and bore and another tool landed in the pocket thereof and adapted, upon the supply of control fluid thereto, to open the flapper and hold it in open position prior to lowering of the tubing string into the well bore, and provide a r servoir in the tool for containing the control fluid in order to permit the integrity of the control line to be tested;

FIGS. 9A, 9B, and 9C are vertical sectional views of the upper, intermediate, and lower portions of another tool landed in the pocket of the mandrel, following removal of the tool of FIGS. 8A to 8C, and adapted, in response to the supply of control fluid, to release the packer preparatory to expanding it against the well bore and open a passageway bypassing the packer when so expanded;

FIGS. 10A, 10B and 10C are vertical sectional views of the upper, intermediate and lower portions of another tool landed in the pocket of the mandrel, following expansion of the packer and opening of the bypass and removal of the tool of FIGS. 9A to 9C therefrom, and adapted, in response to the supply of pressure fluid thereto, to open the flapper and connect upper and lower portions of the gas passageway with one another to permit fluid to be circulated downwardly through the annulus and bypass and up the tubing to clean out kill fluids which might contain abrasive damaging to the seal surfaces of the mandrel; and FIGS. 11A, 11B and 11C are vertical sectional views of the upper, intermediate and lower portions of a still further tool landed within the pocket of the mandrel, following removal of the flow controlling tool of FIGS. 3A to 3C through 7A to 7C, and adapted, in response to the supply of control fluid thereto, to move the flapper to open position and hold it in open position and to divert control fluid into a passageway in the mandrel connecting with a pressure responsive mechanism of a wireline retrievable tubing mounted safety valve installed in the tubing string above the flapper so as to permit operation of same in the event of failure of the flapper.

With reference now to the details of the above described drawings, a tubular body including a mandrel 20 is shown in FIG. 1 to be connected as part of a tubing string suspended within a cased well bore 21 and to be packed off therein by means of a packer 22 carried by the body string beneath the mandrel. More particularly, the packer is shown to comprise a packing element 23 expanded into sealing engagement with the well bore above slip assemblies 24 which hold it against vertical movement. The mandrel has a bore 25 therethrough which forms a continuation of the bore through the tubing string and a pocket 26 to one side of the bore having an open upper end through which a tool TAB has been lowered into landed position in the pocket.

A flapper 27 is pivotally mounted on the mandrel for movement between positions closing the mandrel bore, as shown in FIG. 1, and to one side thereof to open the bore, as indicated in FIG. 7C. More particularly, the flapper is urged upwardly against a downwardly facing seat on the bore of the mandrel by means of a coil spring 28, so as to maintain it in closed position, and, when open, is disposed within an enlarged portion of the bore of the mandrel beneath the pocket. As described in detail in connection with prior U.S. Pat. No. 4,325,431, the bore and flapper are mounted eccentrically with respect to the mandrel and thus in a position to provide room for the pocket 26 and tools to be landed therein.

As will be described in more detail to follow, a flow tube 30 is mounted for vertical reciprocation with respect to a lower continuation of the mandrel bore and above the flow tube so as to move the flapper to open position when the flow tube is lowered, as will be described to follow. For a more detailed description of the flow tube and its relationship to the flapper, reference is made to the aforementioned U.S. Pat. No. 4,325,431. In any event, the flapper has a flange thereabout and a rod 31 which extends upwardly from the flange beneath the lower end of the pocket 26 in the mandrel, and thus beneath the lower end of the tool TAB within the pocket.

As in the apparatus of the aforementioned U.S. Pat. No. 4,325,431, a control line extends downwardly from the surface for connection with a passageway in the mandrel leading to the pocket so as to permit control fluid to be supplied to parts of the tool TAB, or another tool disposed in the pocket, for purposes to be described to follow. Thus, in the case of the tool TAB, the supply of control fluid is effective to lower an actuator rod to engage the rod 31 of the flow tube and thus lower the flow tube 30 for the purpose of moving the flapper 27 to open position. More particularly, and in accordance with the present invention, upper and lower portions of a gas passageway intersect with the pocket, and thus, through valve means within the tool TAB, connect the annulus between the tubing string and the well bore above the packer with the annulus below the packer.

For this latter purpose, the lower portion of the gas passageway connects with conduits 32 which, as shown in FIGS. 1 and 1A, extend downwardly from the mandrel to one side of the flapper for connection at their lower ends with passageways 32A through a lower mandrel of the tubular body leading to the bypass in the packer, as shown and described in detail in U.S. Pat. No. 4,540,047. As will be understood from that patent, as well as the description to follow, at the time the tool TAB is installed, the packer has been released and set, as shown in FIG. 1, and a bypass therein has been opened to continue the gas passageway connecting the annulus above and below the packer.

Figure 2:
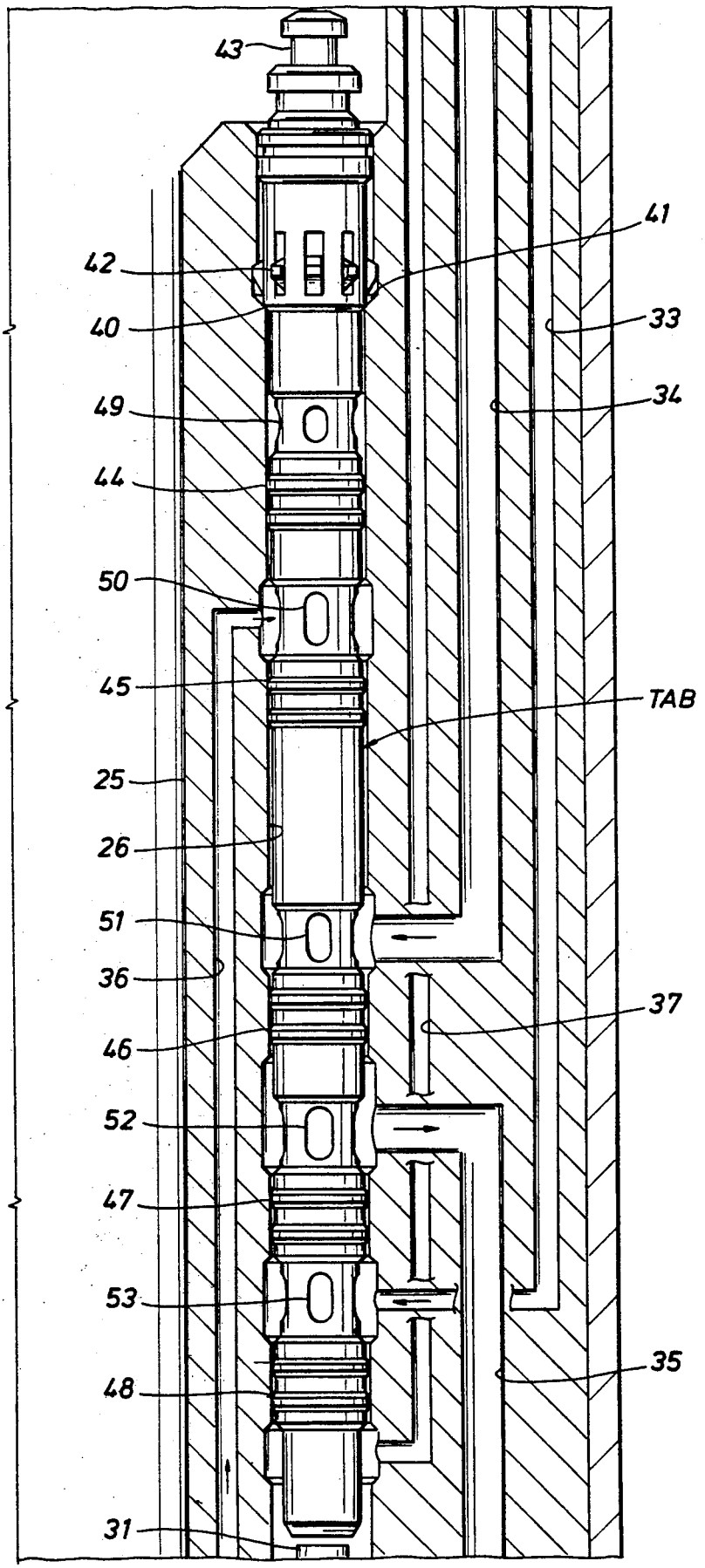
FIG. 2 is a developed sectional view of the mandrel to show various passageways in the mandrel connecting with the pocket and their relationship to the flow controlling tool landed in the pocket thereof.

The above described control line from the source of control fluid at the surface connects with the upper end of mandrel passageway 33 which, as shown in FIG. 2, intersects the pocket 26 near its lower end. The upper and lower portions of the gas passageway for connecting the annulus above and below the packer are shown in FIG. 2 at 34 and 35, respectively, to connect with the pocket above the connection therewith of the control line passageway 33. The bore of the mandrel above and below the flapper is adapted to be connected by means which includes an equalizing passageway 36 in the mandrel which connects at its upper end with the open upper end of the pocket 26 and at its lower end with the bore of the mandrel beneath the closed flapper. Reference in this regard is made to the aforementioned U.S. Pat. No. 4,325,431. A still further passageway 37 in the mandrel is shown in FIG. 2 to connect at its lower end with the pocket beneath the connection therewith of the control fluid passageway 33 and to extend upwardly therefrom for connection with the pressure responsive mechanism of a tubing safety valve installed within the tubing string, as previously mentioned, and as will be described to follow in connection with the tool of FIGS. 11A to 11C.

As shown in FIG. 2, the tool TAB is landed within the pocket by means of a shoulder 40 about its upper end landed upon a seat 41 in the upper end of the pocket. The tool is locked down in landed position by locking dogs 42 which may be of conventional construction and move between locking and unlocking position in the manner shown in the aforementioned U.S. Pat. No. 4,325,431. A fishing neck 43 at the upper end of the tool permits it to be raised and lowered by means of a wireline.

An upper set of seal rings 44 is carried about the TAB tool for sealably engaging the pocket above the intersection of the upper end of the equalizing passageway 36 with the pocket, and a set of seal rings 45 is carried about the tool for sealably engaging the pocket beneath the upper end of the equalizing passageway 36 but above the intersection of the lower end of the upper portion 34 of the gas passageway with the pocket. Another set of seal rings 46 is carried about the tool to sealably engage the pocket intermediate the intersection therewith of the portion 34 of the gas passageway and the intersection therewith of the lower portion 35 of the gas passageway. A set of seal rings 47 carried about the tool intersects the pocket between the upper end of the passageway portion 35 and the intersection of the lower end of the control line passageway 33 with the pocket, while a lowermost set of seal rings 48 about the tool engages with the pocket intermediate the intersection therewith of the control line passageway 33 and the intersection therewith of the passageway 37 leading to the alternative tubing safety valve.

Tool TAB comprises a tubular body having ports 49 and 50 formed therein to connect its interior chamber 55 with the pocket above seal rings 44 and intermediate the seal rings 44 and 45, and ports 51 connecting its interior with the pocket 26 intermediate the seal rings 45 and 46. Ports 52 connect the interior of the tool with the pocket intermediate the seal rings 46 and 47, while the ports 53 connect the interior of the tool with the pocket intermediate the seal rings 47 and 48.

The lower end of the chamber 55 of the tool TAB is closed by piston 56 sealably slidable therein beneath the ports 53, and the upper end thereof is closed by dome 57 in its upper end. Flow within the chamber between the equalizing ports 49 and 50 is controlled by valve member 66 adapted to move upwardly into seating engagement with a shoulder 67 about the chamber. Flow within the chamber between the upper and lower portions 34 and 35 of the gas passageway is controlled by means of a valve member 68 adapted to move upwardly into seating engagement with a shoulder 69 about the chamber.

The flapper 27 is adapted to be moved from its closed to its open position by means of an actuator rod 70 extending downwardly from the piston 56 within the chamber and in vertical alignment with the rod 31 extending upwardly from the flange about the flow tube 30. Prior to the supply of control fluid to the tool TAB, the piston and actuator rod occupy the upper position of FIGS. 3B and 3C and are held in that position by means of a shear pin 72 mounted within a lower guide portion 73 of the chamber through which the rod extends closely.

An upper extension 76 of the rod 70 extends upwardly from the piston 56 and through a collar 77 seated to dispose its upper end beneath the valve member 68. More particularly, a coil spring 78 surrounds the upper extension and acts between the collar 77 and the lower side of the valve member 68 to hold the valve member in the seated position of FIG. 3B. A skirt 81 on the lower end of the valve member extends downwardly over the upper end of the coil spring and is sealably slidable within a seal ring 82A carried within the chamber beneath the ports 52.

Figure 3A:
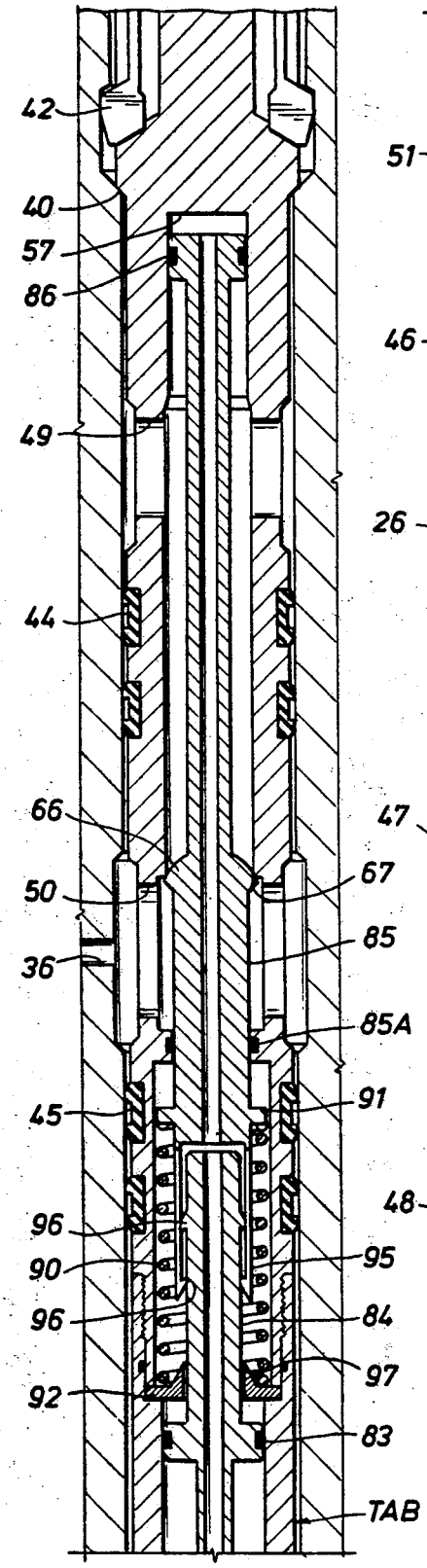
FIGS. 3A, 3B and 3C are vertical sectional views of the upper, intermediate and lower portions of the tool of FIG. 2 in landed position within the pocket and prior to the supply of control fluid to move the flapper and valve means to open positions.
Figure 3B:
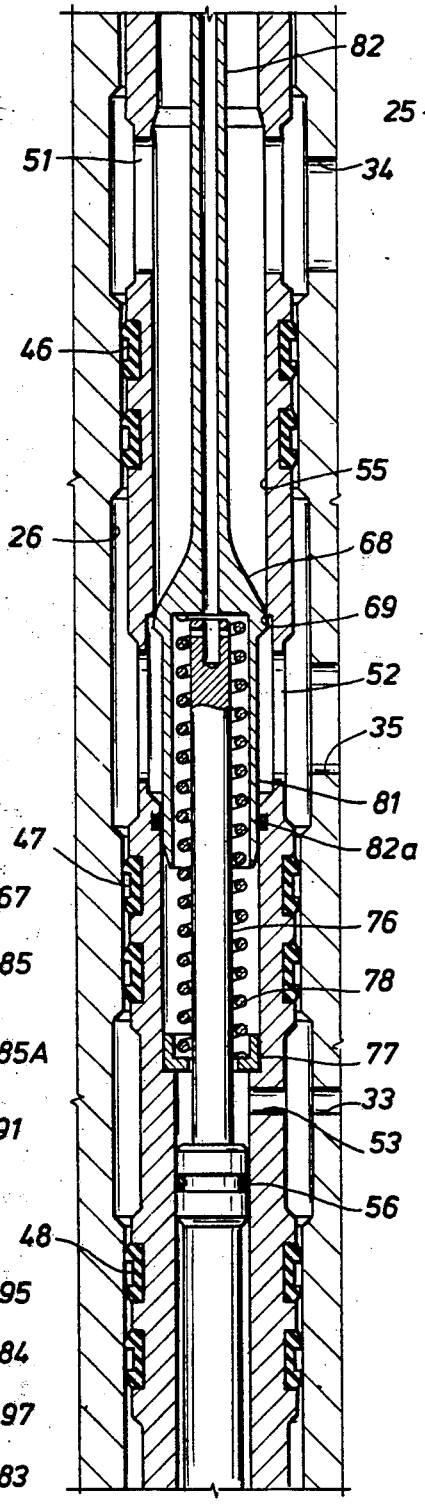
Figure 3C:
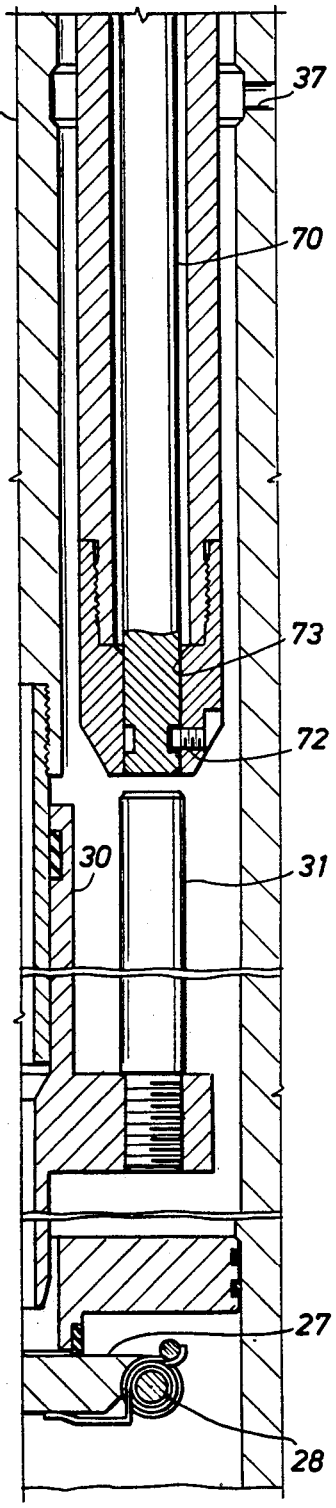

A hollow rod 82 extends upwardly from the valve member 68 to a piston 83 thereabout which is sealably slidable within the chamber above the ports 51 but below ports 50 in the tool. An enlarged diameter portion 84 of the rod 82 extends upwardly from the piston into a position beneath a hollow rod 85 extending downwardly from the valve member 66 and sealably slidable within an O-ring 85A carried in the chamber beneath ports 50. A reduced diameter portion of the hollow rod extends upwardly into the dome 57 of the chamber and terminates in a piston 86 which is sealably slidable within the dome above the equalizer ports 49. A coil spring 90 extends between a flange 91 about an intermediate portion of the lower end of the rod 85 and a collar 92 seated within the chamber above the piston 83 to yieldably urge the equalizer valve member 66 to its closed position, as shown in FIG. 3A.

Spring fingers 95 extend downwardly from the lower end of the rod 85 and about the upper end of the rod 84 within the coil spring 90, and have hooks 96 on their lower ends beneath an annular detent shoulder 96 about the rod 84. The collar 92 has an upwardly and inwardly tapered portion disposed beneath similarly tapered portions on the lower ends of the spring fingers 96. Thus, the annular shoulder 96, spring fingers and collar are adapted to cooperate to form a detent mechanism which, as will be described to follow, permits the valve member 66 to be moved downwardly to its open position, along with the rod 84 extending above the valve member 68, and then released for return, under the urging of coil spring 90, back to its seated position where it remains during closing movement of the valve member 68 and flapper 27.

Prior to the supply of control fluid to the tool TAB, coil spring 78 will maintain the valve member 68 closed, while coil spring 90 will hold the valve member 66 closed, thereby closing the passageways connecting the bore of the mandrel above and below the flapper as well as the annulus above and below the packer. When supplied through passageway 33 and ports 53 into the chamber within the tool, control fluid will act over the upper end of piston 56 and pass upwardly through the hollow rod 82 so as to act downwardly upon the upper end of piston 83. This same control fluid will also pass upwardly through the rod 85 into the dome 57 and thus act over the upper end of piston 86. The cross-sectional area of the piston 83 is greater than that of the seal ring 82*a* within which the skirt 81 depending from the valve member 68 is slidable so that control fluid will urge the valve member 68 downwardly toward its open position. On the other hand, the seal ring 85 A through which rod 85 extends beneath the ports 50 has the same outer diameter as the piston 86 to equalize control fluid across the valve member 67 so that it will remain in seated position under the urging of the spring 90 until pulled downwardly in response to downward opening movement of the valve 68, as will be described.

Figure 4A:
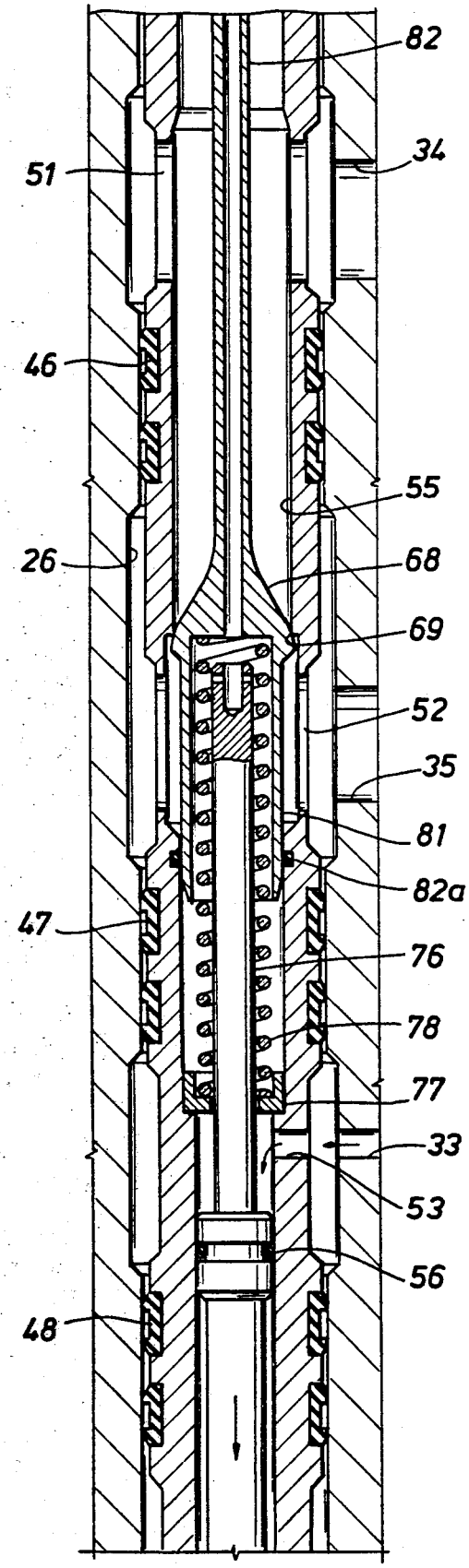
FIGS. 4A and 4B are vertical sectional views of the intermediate and lower portions of the tool and pocket, similar to FIGS. 3B and 3C, but following the supply of control fluid to move an actuator rod within the tool in a downward direction to engage at its lower end with a flow tube surrounding the bore of the mandrel.
Figure 4B:
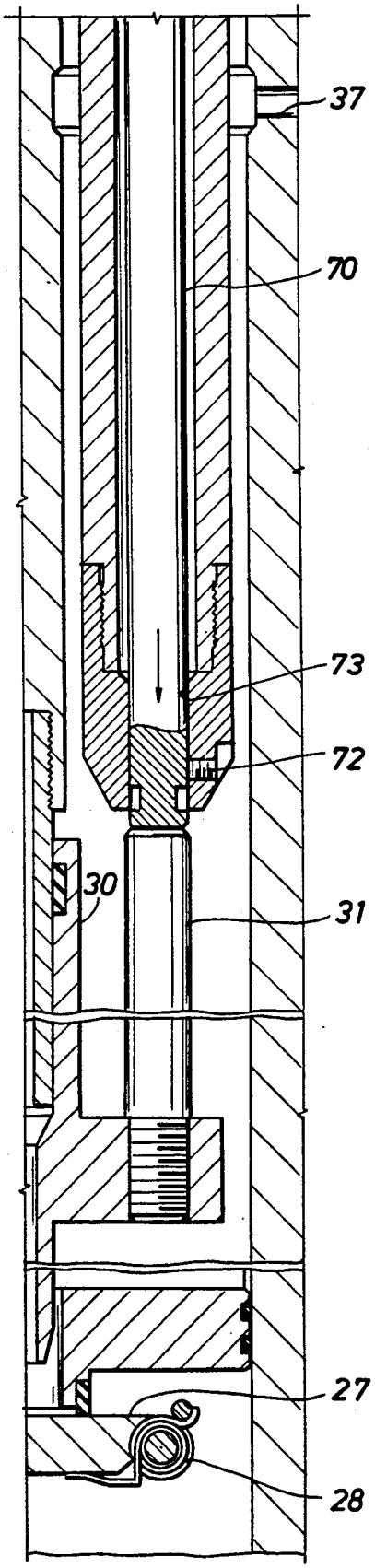

As illustrated in FIGS. 4A and 4B, the supply of control fluid to the interior of the tool TAB and thus to piston 56 will initially shear the pin 72 holding actuator rod 70 in its retracted position and thus lower the actuator rod 70 into engagement with the upper end of the rod 31. During this initial downward movement of the actuator rod, the valve member 68 will remain seated since the force due to control pressure acting downwardly over the piston 83 is not sufficient to overcome the upward force of the spring 78. As previously described, the lower end of the flow tube 30 is initially disposed above the upper end of the flapper 27 so that this initial downward movement of the actuator rod will not open the flapper.

In response to the continued supply of control fluid, and the increase in its pressure due to the resistance of the actuator rod 70 to downward movement, following engagement with the upper end of the rod 31, the downward force due to control fluid on the piston 83 will overcome the force of the spring 78 and thus move the valve member 68 to partially open position. This of course connects the ports 52 and 51 and thus the upper and lower portions 34 and 35 of the gas passageways.

At the same time, the control fluid is effective to further lower the actuator rod 70 and thus lower the flow tube to move its lower end closer to the upper end of the flapper, as shown in FIG. 5B, and to lower the rod extension 84 so as to lower detent shoulder 96 into engagement with the lower ends of the spring fingers 95. This then pulls the rod 85 downwardly and thus lowers the valve member 66 to the open position shown in FIG. 5A. As a result, passageway 36 is connected through equalizing ports 49 and 50 to the pocket 26 above seal rings 44 so as to permit pressure to equalize across the closed flapper prior to engagement of the flow tube with the flapper for moving it to open position.

The continued supply of control fluid will move the piston 56 and actuator rod further downwardly so as to in turn lower the flow tube to a position in which its lower end engages the upper end of the flapper. At this point, as shown in FIG. 6A, the lower ends of the spring fingers have moved to a position just above the tapered surface on the collar 92 as the valve member 68 continues to move downwardly to its full open position and the rod 84 above it is pulled downwardly with it.

As shown in FIGS. 7A to 7C, the continued supply of control fluid will lower the piston 56 and thus the actuator rod 70 so as to in turn force the flapper to the open position, as shown in FIG. 7C. As the flapper is swung to open position, the flow tube and thus the actuator rod are free to continue moving downwardly until the flange on the flow tube engages the body on which the flapper is mounted. At this time, and as previously described, the flapper is moved into an enlarged diameter portion of the bore of the mandrel beneath the lateral supporting body.

At the same time, the valve member 68 continues to move downwardly until a shoulder 68A about it engages a seat 68B about the chamber beneath the ports 52 but above port 53 in the tool. This continued downward movement of the valve member and the hollow rods 82 and 84 extending above it will continue to lower the equalizing valve member 66, and thus the spring fingers 95 depending from it, until the lower ends of the fingers move over the tapered surface 97 on the collar 92, and are wedged outwardly from beneath the shoulder 96 about the rod 84 so as to release the detent mechanism pulling the valve member 66 downwardly. When so released, the equalizing valve member is urged back upwardly to its closed position, as shown in FIG. 7A, under the urging of coil spring 90, which, as previously noted, is the only force which controls movement of the equalizing valve member.

More particularly, the detent mechanism will release the equalizing valve member for return to its closed position shortly following initial opening movement of the flapper, following which the flapper and gas passageway valve member 68 later return to their closed positions, upon loss of control fluid, without reopening the equalizing valve member. That is, upon loss of control fluid, the hollow rod 84 extending upwardly from the valve member 68 will merely move upwardly from the position of FIG. 7A back to the position of FIG. 3A. In doing so, it will spread the lower ends of the spring fingers 95 outwardly to permit the shoulder 96 thereabout to return to a position above the lower ends of the spring fingers, as shown in FIG. 3A. This of course has no effect upon the closed valve member 66, thus avoiding the problems previously mentioned in connection with more conventional equalizing valve arrangements.

As previously mentioned, the tool shown in FIGS. 8A, 8B and 8C, and indicated in its entirety by the reference character CLD, is installed in the pocket 26 of the mandrel at the time the mandrel is lowered with the tubing string into the well bore, its purpose being to isolate the control fluid supply line so that its integrity may be tested. For this purpose, and to facilitate lowering of the tubing string, tool CLD includes an actuator rod 100 guidably movable within a guide surface 102 in the lower end of the tool in vertical alignment with the upstanding rod 31 of the flow tube and adapted to engage and lower the flow tube, and thus open the flapper (not shown) prior to running of the tubing string. As shown, the rod is initially held in its retracted position by means of a shear pin 103, and an O-ring 101 is carried about the guide surface 102 in the lower end of the tool.

The tool has a dome 104 at its upper end so as to provide an enclosed pressure reservoir within its chamber above the seal ring 101 except for a port 105 formed in an intermediate portion of the tool. This port and the interesection of control line 33 with the pocket are located intermediate seal rings 106 about the tool sealably engageable with its inner chamber above the intersection of the control line 33 with the pocket 26, and seal rings 107 about the tool sealably engageable with the chamber below the interesection of the control line, whereby, control fluid is supplied to the pressure-tight chamber within the tool through passageway 33 so as to shear the pin 103 and lower the control rod in order to open the flapper prior to running of the tubing string.

The rod is held down in its flapper opening position by means of split ring segments 108 carried within the chamber of the body for engaging with ratchet teeth 109 about the actuator rod as it is lowered to its flapper opening position. Thus, as shown, the split ring segments 108 have upwardly and inwardly tapered surfaces engageable with corresponding surfaces 110 about the inner chamber of the tool to permit the rod to move downwardly but prevent retrograde upward movement through the segments. As previously described, when the tubing string has been lowered into the well bore with the tool CLD in place, and the flapper held is in its open position, control fluid may be supplied through the control line to the inner chamber of the tool so as to test its integrity. Following such testing, the tool CLD may be removed from the pocket 26 by release of the locking dogs 42 which hold it downwardly in landed position on a shoulder within the upper end of the pocket. In this latter respect, the upper end of the tool CLD is similar to that of the tool TAB.

At this stage, the tool shown in FIGS. 9A, 9B and 9C, and indicated in its entirety by reference character HSD, is lowered into landed position within the pocket 26 for use in releasing the packer carried about the tubing string beneath the flapper in preparation for expansion into sealing engagement with the well bore and for opening the bypass through the packer which forms a part of the passageway connecting the annulus above the packer with the annulus below the packer. As can be seen from FIGS. 9A to 9C, the tool HSD is similar in many respects to the tool TAB, in that it includes an actuator rod 120 vertically reciprocable within the chamber within the tool between the upper position shown in the drawings, and a lower position in which it engages an upstanding rod 31 of the flow tube 30 in order to lower the flow tube and thus open the flapper 27, as described in connection with the tool TAB. In this case, however, a seal ring 121 is carried within the guide surface 122 in the lower open end of the tool so as to form a sliding seal with the actuator rod and thus close off the end of the chamber in the tool, whereby control fluid is effective over the cross-sectional area of the actuator rod to move it downwardly.

The tool HSD is also similar to the tool TAB in that it includes a valve member 123 which is yieldably urged by a coil spring 124 into a position closing off the gas passageway when in its upper seated position. As in the case of the valve member of the tool TAB, a hollow rod 124 extends upwardly from the valve member 123 and has a piston 125 thereabout for sealably engaging the chamber within the tool above ports 126 connecting the chamber in the tool with its outer side.

More particularly, the tool HSD also includes an equalizer valve member 127 adapted to seat on a restriction in the chamber of the tool to close same above ports 128 in the tool. Thus, a hollow rod 129 depending from the valve member 127 is sealably slidable within a seal ring 130 carried by a restriction in the chamber of the tool below the equalizing ports 128. As in the case of the tool TAB, this equalizing valve member is urged upwardly to its closed position by means of a coil spring 131. Furthermore, spring fingers 132 depend from the lower end of the rod 129 to form a detent mechanism cooperable with a shoulder 133 formed about an extension 134 of the valve member above piston 125 as well as a tapered surface 135 formed on the upper side of a collar supported in the chamber beneath the coil spring 131. As also true of the tool TAB, an upward tubular extension 135 of the equalizing valve 127 connects at its upper end with a dome 136 in the top of the tool and carries a piston 137 thereabout for sealably engaging within the dome. The seal rings 137 and 130 are of equal diameter so that the only vertical force acting on the equalizer valve 127 is the coil spring 131 holding it in closed position.

The tool HSD also includes seal rings 140 carried thereabout for sealably engaging the pocket 26 intermediate the equalizing ports 36 in the tool and above the intersection of the equalizing passageway 36 with the pocket 26. The tool further includes, similarly to the tool TAB, additional seal rings 141 sealably engaging the inner chamber of the tool intermediate the intersection of the equalizing passageway 36 and upper portion 34 of the gas passageway with the pocket. The tool HSD further includes, similarly to the tool TAB, seal rings 142 carried thereabout for sealably engaging the chamber within the tool beneath the intersection with the pocket of the upper portion 34 of the gas passageway connecting with the annulus above the packer and the intersection of the lower portion 35 of the passageway leading to the bypass for connecting with the annulus below the packer as well as below ports 126 in the tool.

Additionally, the tool HsD includes seal rings 150 carried thereabou' for sealably engaging the pocket 26 beneath the intersection with the pocket of the control line 33 and above the intersection therewith of the lower end of the passageway 37 leading to the pressure responsive mechanism of the wireline retrievable safety valve installed in the tubing above the flapper 27. The tool HSD differs from the tool TAB, however, in that it does not carry seal rings closing the annular space between it and the pocket intermediate the intersections with the pocket of the lower portion 35 of the passageway means and the control line 33. In addition, the cross-sectional area of the seal ring 125 will be somewhat smaller than that of the cross-sectional area of the seal ring 83 of the tool TAB, but nevertheless somewhat larger than the cross-sectional area of the seal ring carried about the chamber for sealably engaging the lower extension or skirt of the valve member 123. As a consequence, it is anticipated that the preliminary supply of control fluid to the pocket and thus to the tool HSD will merely lower the control rod 122 so as to move the flapper (not shown) to its open position, as described in connection with the tool TAB, but without also opening the valve member 123, and thus of course without opening the equalizing valve. Thus, at this stage of the completion process, the pressure of well fluid beneath the initially closed flapper is not sufficiently high to impede its opening movement in response to lowering of the control rod.

Due to the fact that the annular passageway between the tool and pocket intermediate the intersection of the control line 33 and lower portion 35 of the passageway is open, control fluid supplied through the control line will enter the lower portion 35 and thus pass downwardly into the packer bypass for the purpose of releasing the mechanism holding the packer in retracted position and removing the obstruction within the bypass so as to thus open the gas passageway connecting the annulus above and below the packer except for the valve member 123. As described in the aforementioned U.S. Pat. No. 4,540,047, when the packer is released from its contracted position, its packing element may be expanded to set it in response to the supply of tubing pressure through a port in the tubing leading to a pressure responsive expanding mechanism of the packer. The opening of the flapper will, of course, permit plugs or other suitable mechanisms to be lowered past it in order to close off the tubing beneath the ports leading to the packer setting mechanism.

With the packer set, the operator may reduce control pressure within the control line to permit the control rod 120 to be raised due to pressure acting across its lower end, thus in turn permitting the flapper to be moved to closed position. At this time, the operator may cause control fluid to be circulated down through the control line and into the open annular space from the connection of the control line 33 to the connection of the lower portion 35 of the gas passageway, and thus through the lower portion and through the open bypass in the packer. Thus, control line fluid continues to flow downwardly within the annulus and back up the tubing so as to test the sealing integrity of the closed flapper from beneath it.

Upon removal of the HSD tool, the tool shown and described in connection with FIGS. 10A to 10C, and indicated in its entirety by reference character SAD, may be lowered through the tubing string and into the pocket 26, where it is landed and locked down as shown. The purpose of the tool SAD is to enable the flapper and the annulus above and below the packer to be held open, all in response to the supply of control fluid, to permit fluid to be circulated downwardly through the annulus and up the open tubing to clean out well fluids which might contain abrasives damaging to the seal surfaces of the mandrel prior to installation of the TAB tool for use in maintaining control over the tubing and annulus.

Thus, the SAD tool includes, as in the case of the TAB tool, an actuator rod 160 vertically reciprocal within the chamber of the tool between an upper, retracted position and a lower position in which it engages the rod 31 on the flow tube to lower the flow tube and thus open the flapper (not shown). As in the case of the control rod of the tool TAB, rod 160 is releasably held in its upper position by means of a shear pin 161 engaging in a groove about the lower end of the rod guidably received within guide surface 162 at the lower end of the open end of the chamber in the tool. Similarly, the actuator rod has a piston 163 which sealably engages the chamber beneath port 164, which connects the chamber with the outside of the tool intermediate seal rings 165 and 166 about the tool sealably engaging pocket 26 above and below the intersection of control line 33. This of course enables control fluid in the control line to be introduced into the chamber of the tool for acting over the upper end of the piston 163 on the actuator rod 160 to urge it downwardly.

Tool SAD further includes seal rings 168 thereabout which sealably engage the pocket above the port 167 and the intersection of the lower portion 35 of the passageway with the pocket and below the intersection of the upper portion 34 of the passageway with the pocket and ports 169 through the tool connecting its chamber with its outer side. It further includes seal rings 170 thereabout which sealably engage the pocket above the ports 169 and intersection with the pocket of the lower portion 34 of the passageway and below the intersection of equalizer passageway 36 with the pocket and ports 172 in the tool. Still additional seal rings 171 surround the tool to sealably engage the pocket above the ports 170A in the tool and the intersection of the equalizer passageway 36 with the pocket.

The tool also includes a hollow rod 172 having a piston 173 sealably engaging the chamber of the tool intermediate the ports 169 and 172 and a lower end which is telescopically received over an upper extension of the actuator rod 160 and which is sealably slidable within seal rings 174 carried about the chamber in the tool beneath the ports 167 and above the port 164. The hollow rod 172 is yieldably urged tc an upward position by means of a coil spring 176. However, as compared with the previously described tool TAB, there is no valve member on the rod 172 for closing the annular space between it and the chamber inside the tool. Consequently, fluid may be circulated downwardly through the annulus of the well through the upper portion 34 and lower portion 35 of the annulus passageway, and then upwardly into the lower end of the tubing and through the flapper which has been opened by downward movement by the actuator rod 160 in response to the supply of control fluid to the upper side of the piston 163.

As in the case of the prior tools, the tool SAD also has a dome 180 at its upper end and an equalizing valve member 181 adapted to engage a downwardly facing seat in the chamber of the tool to close the equalizing passageway between the intersection of the passageway 36 with the upper ports 49 in the tool connecting the chamber in the tool with its outer side above the seal rings 171. As in the case of the prior described tools, the valve member 181 is mounted on a hollow rod 182 which extends downwardly through a seal ring 183 and which has a piston 184 at its upper end sealably slidable within the chamber beneath the dome 180. Seal rings 183 and 184 are of equal diameter so as to equalize pressure across the upper and lower ends of the equalizing valve. The equalizing valve is normally held in its closed position by means of a coil spring 185.

As also shown in FIG. 9A, spring fingers 186 depending from the lower end of the hollow rod 182 beneath the valve member 181 are engageable with a flange 187 about the hollow rod 188 extending upwardly from the piston 173 whereby downward movement of the control rod 188 will engage the lower ends of the spring fingers and pull them downwardly to move the equalizing valve member 181 to its open position. Thus, as in the TAB tool, the area across piston 173 is greater than that across seal ring 174, so that the introduction of control fluid through the control line 33 is effective to lower the rod 188 in order to then open the valve member 181. As described in connection with the TAB tool, this opens the equalizing valve connecting with the mandrel bore above and below the flapper prior to lowering of the control rod 160 to a position for moving the flapper to its open position. Then, upon continued lowering of the control rod 160 to open the flapper, the tool is prepared for circulation downwardly through the annulus and upwardly through the tubing, as previously described.

At this time, the SAD tool is removed from the pocket and replaced by the previously described TAB tool which controls flow through the tubing and annulus in the manner previously described. In order to provide a backup for the TAB tool, and thus maintain control over the flow through the tubing in the event the flapper 27 does not close, it may be desirable to install another safety valve within the tubing above the flapper. More particularly, it is contemplated that this backup valve would have a flapper or other closure member adapted to be held open in response to the supply of control fluid, and adapted to close upon loss of the control fluid.

The tool which is shown and described in connection with FIGS. 11A, 11B and 11C, and indicated in its entirety by reference character LOT, is useful in providing this control for the backup safety valve in that it serves to transmit control fluid supplied to the pocket 26 upwardly to the pressure responsive mechanism of the tubing safety valve for maintaining it in an open position. Thus, in the event the flapper malfunctions and will not return to its seated position, the operator retrieves the TAB tool and replaces it with the LOT tool which is lowered into and landed and locked down within the pocket 26 as shown in FIGS. 11A to 11C.

The tool LOT includes an actuator rod 200 vertically reciprocal within its chamber for movement downwardly, in response to the supply of control fluid to the pocket 26 to engage and lower the flow tube and thus move the flapper to its fully open position. Thus, the control rod is sealably slidable within a seal ring 201 carried within an annular guide surface 202 in the open lower end of the chamber of the tool and has a port 203 therein connecting its chamber above the piston with the outer side thereof intermediate seal rings 204 and 205 about the tool sealably engaging the pocket 26 above and below the intersection of control line passageway 33 with the pocket. Thus, control fluids supplied through the control line acts over the control rod to shear a pin holding it in retracted position and lower it for the purpose of fully opening the flapper.

Similar to the CLD tool, the control rod is locked down in its lower position so as to hold the flapper open. For this purpose, the rod has rachet teeth 208 thereabout which move downwardly through split ring segments 209 in the chamber, but are prevented from moving upwardly therethrough by virtue of the fact that the upper end of the split ring segments is moved upwardly against the tapered surface 210. Since the flapper is locked open, it no longer provides control over flow through the tubing, such that the control therethrough may be provided by the upper wireline retrievable tubing safety valve.

The LOT tool also has a port 211 formed therein connecting its chamber with its outer side above seal rings 212 carried about the tool. The passageway 37 intersects the pocket intermediate seal rings 205 and 212 and thus connects port 211 with a passageway extending upwardly to the pressure responsive mechanism of the tubing safety valve, as previously described. Consequently, the supply of control fluid to the pocket and the tool LOT not only locks the flapper open, but also supplies control fluid to the wireline retrievable tubing safety valve so that control may be maintained over the flow through the tubing at that level.

At the same time, the LOT tool provides control between the annulus above and below the packer by means of a valve member 213 adapted to be urged upwardly by means of a coil spring 214 to a position closing a gas passageway in the chamber. Thus, the valve member controls flow between the intersection of the lower portion 35 of the gas passageway and the upper portion 34 of the gas passageway with the pocket. For this purpose, the LOT tool is similar to the previously described tools in that it includes ports 217 connecting its chamber beneath the valve member 213 with its outer side above seal ring 218 surrounding a lower extension of the valve member and ports 219 connecting the chamber with its outer side above the seal rings 215 and below additional seal rings 220 carried about the LOT tool for sealably engaging the pocket above the intersection of the upper portion 34 of the passageway therewith.

More particularly, a tubular rod 221 extending upwardly from the valve member 213 has a piston 222 thereabout sealably slidable within the chamber beneath a dome 223 closing the upper end of the tool. Thus, control fluid is free to flow upwardly through the hollow tube and into the dome so as to act over the upper end of piston 222. The force due to this pressure acting on the piston 222 is of course opposed by the upward force of control fluid acting across the seal ring 218 surrounding the lower extension of the valve member 213, the valve member being yieldably urged to its upper position by means of the coil spring 214. More particularly, the cross-sectional area of piston 222 is greater than that of seal ring 218 so that control fluid entering the dome and acting on the upper side of the piston 222 is effective to lower the valve member 213 to open the upper and lower portions 34 and 35 of the passageway for communication with one another through the ports 216 and 219. Then, of course, upon the loss of control fluid, the valve member 213 is permitted to return to its closed position to close the gas passageway.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

WHAT IS CLAIMED IS:

1. Apparatus for use in controlling flow within a tubing string suspended and packed off within a well bore as well as the annulus between the tubing string and well bore above and below the packer, comprising a mandrel having a bore therethrough adapted to be connected as part of the tubing string and a pocket having an opening to one side of the bore, a closure member movable within the bore of the mandrel between positions opening and closing the bore beneath the pocket opening, means urging the closure member to the closed position, a tool movable vertically through the tubing string into and out of a landed position within the pocket, said mandrel and tool having means which, when the tool is landed in the pocket, forms first passageway means for connecting the annulus above and below the packer, said tool having an actuator movable between a first position permitting the closure member to move to the closed position and a second position in which it moves the closure member to the open position, valve means movable from a first position closing the first passageway means to a second position opening the first passageway means, and pressure responsive means for moving each of said actuator and valve means to its second position, said mandrel and tool also having means which, when the tool is landed in the pocket, forms second passageway means therein through which control fluid may be supplied from a remote source to the pressure responsive means in order to move each of said actuator and valve means from its first to its second positions, and means by which said actuator and said valve means are returned to their first positions following loss of control pressure.

2. Apparatus of the character defined in claim 1, wherein said mandrel and tool also have means which, when the tool is landed in the pocket, forms third passageway means connecting the mandrel bore above and below the closure member, and said tool also has another valve means movable from a first position closing the third passageway to a second position opening same, in response to the supply of control fluid to the pressure responsive means and prior to the opening of the closure member, and means by which said other valve means is returned to and held in its closed position following opening of said closure member.

3. Apparatus of the character defined in claim 1, including a second tool movable vertically through the tubing string for landing in the pocket, prior to landing therein of the first mentioned tool, and having an actuator movable between a first position permitting the closure member to move to the closed position and a second position in which it moves the closure member to the open position, and pressure responsive means for moving said actuator to its second position, and wherein said mandrel and second tool have means which, when the second tool is landed in the pocket, forms first passageway means connecting the annulus above and below the packer as well as second passageway means for supplying control fluid from a remote source to said pressure responsive means so as to open the closure member, whereby fluid may be circulated down through the annulus and up through the tubing string.

4. Apparatus of the character defined in claim 1, including a second tool movable vertically through the tubing string for landing in the pocket following removal of the first mentioned tool therefrom, said mandrel and second tool having means which, when the second tool is landed in the pocket, forms first passageway means for connecting the annulus above and below the packer, an actuator movable between a first position permitting the closure member to move to the closed position and a second position in which it moves the closure member to and holds it in the open position, valve means movable between a first position closing the first passageway means to a second position opening the first passageway means, and pressure responsive means for moving each of said actuator and valve means to its second position, said mandrel and second tool also having means which, when the second tool is landed in the pocket, forms second passageway means for supplying control fluid from a remote source to the pressure responsive means in order to move each of said actuator and valve means to its second position, and means by which said actuator and valve means are returned to their first positions following loss of control line pressure, said mandrel and second tool also having means which, when the second tool is landed in the pocket, forms passageway means for connecting with a pressure responsive means of a safety valve in the tubing string above the closure member.

5. Apparatus for use in controlling fluid within a tubing string suspended and packed off within a well bore as well as the annulus between the tubing string and well bore above and below the packer, comprising a tubular body having a bore therethrough adapted to be connected as part of the tubing string and a pocket having an opening to one side of the bore, a closure member movable within the bore of the body between positions opening and closing the bore beneath the pocket opening, means urging the closure member to the closed position, a packer about the body adapted to be expanded into sealing engagement with the well bore, means movable from a first to a second position for so expanding the packer, a bypass from above to below the packer, means movable between a first position closing the bypass and a second position opening the bypass, pressure responsive means movable between a first position holding each of said expanding means and bypass closing means in its first position and a second position releasing them for movement to their second positions, and means holding said pressure responsive means in its first position, a first tool movable vertically through the tubing string into and out of the pocket, said body and first tool having means which, when the first tool is landed in the pocket, forms passageway means for supplying control fluid from a remote source to the pressure responsive means for releasing said holding means and moving said bypass closing means to its second position so as to permit the packer to be expanded, a second tool movable vertically through the tubing string into and out of a landed position within the pocket, upon removal of the first tool therefrom, said body and second tool having means which, when the second tool is landed in the pocket, forms first passageway means connecting with the open bypass to connect the annulus above and below the packer, said second tool having an actuator movable between a first position permitting the closure member to move to the closed position and a second position in which it moves the closure member to the open position, valve means movable from a first position closing the first passageway means to a second position opening the passageway, and pressure responsive means for moving each of said actuator and valve means to its second position, said body and second tool also having means which, when the second tool is landed in the pocket, forms second passageway means through which control fluid may be supplied to said pressure responsive means in order to move each of said actuator and valve means from its first to its second positions, and means by which said actuator means and said valve means are returned to their first positions following loss of control pressure.

6. Apparatus of the character defined in claim 5, wherein said body and second tool also have means which, when the second tool is landed in the pocket, forms third passageway means connecting the bore of the body above and below the closure member, and said second tool also has another valve means movable from a first position closing the third passageway means to a second position opening same, in response to the supply of control fluid thereto and prior to the opening of the closure member, and means by which said other valve means is returned to and held in its closed position following opening of said closure member.

7. Apparatus of the character defined in claim 5, including a third tool movable vertically through the tubing string for landing in the pocket subsequent to removal of the first tool therefrom but prior to landing therein of the second tool, and having an actuator movable between a first position permitting the closure member to move to the closed position and a second position in which it moves the closure member to the open position, and pressure responsive means for moving said actuator to its second position, and wherein said body and third tool have means which, when the third tool is landed in the pocket, forms first passageway means connecting the annulus above and below the packer as well as second passageway means for supplying control fluid from a remote source to said pressure responsive means so as to open the closure member, whereby fluid may be circulated down through the annulus and up through the tubing string.

8. Apparatus of the character defined in claim 5, including a third tool movable vertically through the tubing string for landing in the pocket following removal of the second mentioned tool therefrom, said body and third tool having means which, when the third tool is landed in the pocket, forms first passageway means for connecting the annulus above and below the packer, an actuator movable between a first position permitting the closure member to move to the closed position and a second position in which it moves the closure member to and holds it in the open position, valve means movable between a first position closing the first passageway means to a second position closing the first passageway means, and pressure responsive means for moving each of said actuator and valve means to its second position, said body and third tool also having means which, when the third tool is landed in the pocket, forms second passageway means for supplying control fluid from a remote source to the pressure responsive means in order to move each of said actuator and valve means to its second position, and means by which said actuator and valve means are returned to their first positions following loss of control line pressure, said body and third tool also having means which, when the third tool is landed in the pocket, forms third passageway means for connecting with a pressure responsive means of a safety valve in the tubing string above the closure member.

9. For use in controlling flow within a tubing string suspended and packed off within a well bore as well as the annulus between the tubing string and well bore above and below the packer, and wherein a mandrel having a bore therethrough is connected as part of the tubing string and has a pocket having an opening to one side of the bore, a closure member movable within the bore between positions opening and closing the bore beneath the pocket opening, and means yieldably urging the closure member to the closed position;

apparatus comprising a tool movable vertically through the tubing string and into and out of a landed position within the pocket, said tool having means which, when landed in the pocket, forms with the mandrel a first passageway for connecting the annulus above and below the packer, an actuator movable between a first position permitting the closure member to move to the closed position and a second position in which it moves the closure member to the open position, valve means movable from a first position closing the first passageway to a second position opening the first passageway, pressure responsive means for moving each of said actuator and valve means to its second position, means which, when the tool is landed in the pocket, forms with the mandrel a second passageway through which control fluid may be supplied from a remote source to the pressure responsive means in order to move each of said actuator and valve means from its first to its second positions, and means by which said actuator and said valve means are returned to their first positions following loss of control pressure.

10. Apparatus of the character defined in claim 9, wherein said mandrel and tool also have means which, when the tool is landed in the pocket, forms with the mandrel a third passageway connecting the bore of the mandrel above and below the closure member, and said tool also has another valve means therein movable from a first position closing the third passageway to a second position opening same, in response to the supply of control fluid thereto and prior to the opening of the closure member, and means by which said other valve means is returned to and held in its closed position following opening of said closure member.

11. Apparatus of the character defined in claim 9, including a second tool movable vertically through the tubing string for landing in the pocket prior to landing therein of the first mentioned tool, and having an actuator movable between a first position permitting the closure member to move to the closed position and a second position in which it moves the closure member to the open position, and pressure responsive means for moving said actuator to its second position, and wherein said second tool also has means which, when the second tool is landed in the pocket, forms with the mandrel a first passageway connecting the annulus above and below the packer as well as a second passageway for supplying control fluid from a remote source to said pressure responsive means so as to open the closure member, whereby fluid may be circulated down through the annulus and up through the tubing string.

12. Apparatus of the character defined in claim 9, including a second tool movable vertically through the tubing string for landing in the pocket following removal of the first mentioned tool therefrom, said mandrel and second tool having means which, when the second tool is landed in the pocket, forms with the mandrel a first passageway for connecting the annulus above and below the pocket, an actuator movable between a first position permitting the closure member to move to the closed position and a second position in which it moves the closure member to and holds it in the open position, valve means movable between a first position closing the first passageway to a second position closing the first passageway, and pressure responsive means for moving each of said actuator and valve means to its second position, said second tool also having means which, when the second tool is landed in the pocket, forms with the mandrel a second passageway for supplying control fluid from a remote source to the pressure responsive means in order to move each of said actuator and valve means to its second position, and means by which said actuator and valve means are returned to their first positions following loss of control line pressure, said mandrel and second tool also having means which, when the second tool is landed in the pocket, forms a third passageway for connecting with a pressure responsive means of a safety valve in the tubing string above the closure member.

13. For use in controlling fluid within a tubing string suspended and packed off within a well bore as well as the annulus between the tubing string and well bore above and below the packer, and wherein a tubular body having a bore therethrough is connected as part of the tubing string, and has a pocket having an opening to one side of the bore, a closure member movable within the bore of the body between positions opening and closing the bore beneath the pocket opening, means yieldably urging the closure member to the closed position, a packer about the body adapted to be expanded into sealing engagement with the well bore, means movable from a first to a second position for so expanding the packer, a bypass from above to below the packer, means movable between a first position closing the bypass and a second position opening the bypass, pressure responsive means movable between a first position holding each of said expanding means and bypass closing means in its first position and a second position releasing them for movement to their second positions, and means holding said pressure responsive means in its first position;

apparatus comprising a first tool movable vertically through the tubing string into and out of the pocket, said first tool having means which, when the first tool is landed, forms with the body a first passageway for supplying control fluid from a remote source to the pressure responsive means for releasing said holding means and moving said bypass closing means to its second position so as to permit the packer to be expanded, a second tool movable vertically through the tubing string into and out of a landed position within the pocket, upon removal of the first tool therefrom, said second tool having means which, when the second tool is landed in the pocket, forms with the body a passageway connecting with the open bypass to connect the annulus above and below the packer, an actuator movable between a first position permitting the closure member to move to the closed position and a second position in which it moves the closure member to the open position, valve means movable from a first position closing the passageway to a second position opening the passageway, and pressure responsive means for moving each of said actuator and valve means to its second position, said body and second tool also having means which, when the second tool is landed in the pocket, forms with the body a second passageway through which control fluid may be supplied to said pressure responsive means in order to move each of said actuator and valve means from its first to its second positions, and means by which said actuator and said valve means are returned to their first positions following loss of control line pressure.

14. Apparatus of the character defined in claim 13, wherein said second tool also has means which, when the second tool is landed in the pocket, forms with the body a third passageway connecting the bore of the body above and below the closure member, and said second tool also has another valve means movable from a first position closing the third passageway to a second position opening same, in response to the supply of control fluid thereto and prior to the opening of the closure member, and means by which said other valve means is returned to and held in its closed position following opening of said closure member.

15. Apparatus of the character defined in claim 13, including a third tool movable vertically through the tubing string for landing in the pocket subsequent to removal of the first tool therefrom but prior to landing therein of the second mentioned tool and having an actuator movable between a first position permitting the closure member to move to the closed position and a second position in which it moves the closure member to the open position, and pressure responsive means for moving said actuator to its second position, and wherein said third tool has means which, when the third tool is landed in the pocket, forms with the body a first passageway connecting the annulus above and below the packer as well as a second passageway for supplying control fluid from a remote source to said pressure responsive means so as to open the closure member, whereby fluid may be circulated down through the annulus and up through the tubing string.

16. Apparatus of the character defined in claim 13, including a third tool movable vertically through the tubing string for landing in the pocket following removal of the second tool therefrom, said third tool having means which, when the third tool is landed in the pocket, forms with the body a first passageway for connecting the annulus above and below the packer, an actuator movable between a first position permitting the closure member to move to the closed position and a second position in which it moves the closure member to and holds it in the open position, valve means movable between a first position closing the first passageway to a second position opening the first passageway, and pressure responsive means for moving each of said actuator and valve means to its second position, said third tool also having means which, when the third tool is in the pocket, forms with the body a second passageway for supplying control fluid from a remote source to the pressure responsive means in order to move each of said actuator and valve means to its second position, and means by which said actuator and valve means are returned to their first positions following loss of control line pressure, said third tool also having means which, when the third tool is landed in the pocket, forms with the body a third passageway for connecting with a pressure responsive means of a safety valve in the tubing string above the closure member.

17. Apparatus for use in controlling flow within a tubing string suspended and packed off within a well bore as well as the annulus between the tubing string and well bore above and below the packer, comprising a mandrel having a bore therethrough adapted to be connected as part of the tubing string and an enlarged portion in which pocket means having an opening to one side of the bore is formed, a closure member movable within the bore of the mandrel between positions opening and closing the bore beneath the pocket means opening, means urging the closure member to the closed position, tool means movable vertically through the tubing string into and out of a landed position within the pocket means, a portion of said tool means having an actuator movable between a first position permitting the closure member to move to the closed position and a second position in which it moves the closure member to the open position, and pressure responsive means for moving the actuator to its second position, said mandrel and another portion of the tool means having means which, when the other portion of the tool means is landed in the pocket means, forms a first passageway means for connecting the annulus above and below the packer, and said other portion of the tool means having valve means movable from a first position closing the first passageway means to a second position opening the first passageway means, and pressure responsive means for moving the valve means to its second position, said mandrel and each of said portions of the tool means having means which, when each portion of the tool means is landed in the pocket means, forms second passageway means through which control fluid may be supplied from a remote source to each said pressure responsive means in order to move each of said actuator and valve means from its first to its second positions, and means by which said actuator and said valve means are returned to their first positions following the loss of control pressure supplied thereto.

18. Apparatus of the character defined in claim 17, wherein said mandrel and one portion of the tool means also have means which, when the one portion of the tool means is landed in the pocket means, forms third passageway means connecting the bore of the mandrel above and below the closure member, and said one portion of the tool means also has another valve means movable from a first position closing the third passageway means to a second position opening same, in response to the supply of control fluid to the pressure responsive means of said one portion, for moving the actuator prior to the opening of the closure member, and means by which said other valve means is returned to and held in its closed position following opening of said closure member.

19. Apparatus of the character defined in claim 17, wherein the pocket means is a single pocket.

20. Apparatus of the character defined in claim 19, wherein the tool means is a single tool.

21. Apparatus for use in controlling fluid within a tubing string suspended and packed off within a well bore as well as the annulus between the tubing string and well bore above and below the packer, comprising a tubular body having a bore therethrough adapted to be connected as part of the tubing string and an enlarged portion in which pocket means having an opening to one side of the bore is formed, a closure member movable within the bore of the body between positions opening and closing the bore beneath the pocket means opening, means urging the closure member to the closed position, a packer about the body adapted to be expanded into sealing engagement with the well bore, means movable from a first to a second position for so expanding the packer, a bypass from above to below the packer, means movable between a first position closing the bypass and a second position opening the bypass, pressure responsive means movable between a first position holding each of said expanding means and bypass closing means in its first position and a second position releasing them for movement to their second positions, and means holding said pressure responsive means in its first position, a first tool movable vertically through the tubing string into and out of the pocket means, said body and first tool having means which, when the first tool is landed in the pocket means, forms passageway means for supplying control fluid from a remote source to the pressure responsive means for releasing said holding means and moving said bypass closing means to its second position so as to permit the packer to be expanded, a tool means movable vertically through the tubing string into and out of a landed position within the pocket means, upon removal of the first tool therefrom, a first portion of the tool means having an actuator movable between a first position permitting the closure member to move to the closed position and a second position in which it moves the closure member to the open position, and pressure responsive means for moving the actuator to its second position, said body and a second portion of the tool means having means which, when the second portion of the tool means is landed in the pocket means, forms first passageway means connecting with the open bypass to connect the annulus above and below the packer, and said second portion of the tool means having valve means movable from a first position closing the first passageway means to a second position opening the first passageway means, and pressure responsive means for moving the valve means to its second position, said body and each of said portions of said tool means having means which, when each portion of the tool means is landed in the pocket means, forms second passageway means through which control fluid may be supplied from a remote source to each said pressure responsive means in order to move each of said actuator and valve means from its first to its second positions, and means by which said actuator means and said valve means are returned to their first positions following the loss of control pressure supplied thereto.

22. Apparatus of the character defined in claim 21, wherein said body and one portion of the tool means also have means which, when the one portion of the tool means is landed in the pocket means, forms third passageway means connecting the bore of the body above and below the closure member, and said one portion of the tool means also has another valve means movable from a first position closing the third passageway means to a second position opening same, in response to the supply of control fluid to the pressure responsive means of the actuator and prior to the opening of the closure member, and means by which said other valve means is returned to and held in its closed position following opening of said closure member.

23. Apparatus of the character defined in claim 21, wherein the pocket means is a single pocket.

24. Apparatus of the character defined in claim 23, wherein the tool means is a single tool.

25. Apparatus for use in controlling flow within a tubing string suspended and packed off within a well bore as well as the annulus between the tubing string and well bore above and below the packer, comprising a mandrel having a bore therethrough adapted to be connected as part of the tubing string and an enlarged portion in which pocket means having an opening to one side of the bore is formed and in which tool means movable vertically through the tubing string may be landed, a closure member movable within the bore of the mandrel between positions opening and closing the bore beneath the pocket means opening, and means urging the closure member to the closed position, said mandrel also having means which, when the tool means is landed in the pocket means forms with a first portion of the tool means a normal closed first passageway means for connecting the annulus above and below the packer and with a second portion of the tool means a second passageway means through which control fluid may be supplied from a remote source to pressure responsive means within each of the first and second portions of the tool means in order to move said pressure responsive means in a direction to open said closure member and open the first passageway means.

26. Apparatus of the character defined in claim 25, wherein said mandrel also has means which, when the tool means is landed in the pocket means, forms with a third portion of the tool means a normally closed third passageway means connecting the bore of the mandrel above and below the closure member and adapted to be opened, in response to the supply of control fluid to pressure responsive means within a third portion of the tool means following opening of the closure member.

27. Apparatus for use in controlling fluid within a tubing string suspended and packed off within a well bore as well as the annulus between the tubing string and well bore above and below the packer, comprising a tubular body having a bore therethrough adapted to be connected as part of the tubing string and an enlarged portion in which pocket means having an opening to one side of the bore is formed and in which a tool and tool means movable vertically through the tubing string may be landed, a closure member movable within the bore of the body between positions opening and closing the bore beneath the pocket means opening, means urging the closure member to the closed position, a packer about the body adapted to be expanded into sealing engagement with the well bore, means movable from a first to a second position for so expanding the packer, a bypass from above to below the packer, means movable between a first position closing the bypass and a second position opening the bypass, pressure responsive means movable between a first position holding each of said expanding means and bypass closing means in its first position and a second position releasing them for movement to their second positions, and means holding said pressure responsive means in its first position, said body also having means which, when the tool is landed in the pocket means, forms tool passageway means through which control fluid may be supplied from a remote source to pressure responsive means within the tool for releasing said holding means and moving said bypass closing means to its second position so as to permit the packer to be expanded, and which, when the tool means is landed in the pocket means, upon removal of the tool therefrom, forms with a first portion of the tool means a normal closed first passageway means for connecting the annulus above and below the packer and with a second portion of the tool means a second passageway means through which control fluid may be supplied from a remote source to pressure responsive means within each of the first and second portions of the tool means in order to move said last mentioned pressure responsive means in a direction to open said closure member and open the first passageway means.

* * * * *